US008944428B2

(12) United States Patent
Piening et al.

(10) Patent No.: US 8,944,428 B2
(45) Date of Patent: Feb. 3, 2015

(54) REMOVABLE MEDIA DAM WITH SEPARATOR ROLL POSITIONER FOR A MEDIA TRAY

(71) Applicant: Lexmark International, Inc., Lexington, KY (US)

(72) Inventors: Chad Michael Piening, Lexington, KY (US); Louann Behymer Samuels, Georgetown, KY (US); Curtis Duane Woodson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 68 days.

(21) Appl. No.: 13/857,318

(22) Filed: Apr. 5, 2013

(65) Prior Publication Data

US 2014/0300046 A1 Oct. 9, 2014

(51) Int. Cl.
*B65H 3/52* (2006.01)
*B65H 3/06* (2006.01)

(52) U.S. Cl.
CPC ..... *B65H 3/0684* (2013.01)
USPC ..... 271/121; 271/124; 271/125; 271/167

(58) Field of Classification Search
USPC ..... 271/121–125, 167
See application file for complete search history.

(56) References Cited

U.S. PATENT DOCUMENTS

| | | | | |
|---|---|---|---|---|
| 5,172,900 | A | 12/1992 | Uno et al. | |
| 7,014,186 | B2 | 3/2006 | Shiohara | |
| 7,036,815 | B2 | 5/2006 | Yamamoto et al. | |
| 7,156,388 | B2 | 1/2007 | Kang | |
| 8,002,261 | B2 | 8/2011 | Hirose | |
| 8,146,913 | B1 * | 4/2012 | Blair et al. | 271/121 |
| 8,757,613 | B2 * | 6/2014 | Yamomoto et al. | 271/121 |
| 8,757,616 | B2 * | 6/2014 | Arimura | 271/258.01 |
| 2003/0080496 | A1 | 5/2003 | Siow | |
| 2005/0275156 | A1 | 12/2005 | Flynn | |
| 2006/0049571 | A1 | 3/2006 | Buxton et al. | |
| 2006/0071405 | A1 | 4/2006 | Kozaki | |
| 2006/0237895 | A1 * | 10/2006 | Nishikata et al. | 271/121 |
| 2007/0132172 | A1 | 6/2007 | Mo | |

FOREIGN PATENT DOCUMENTS

| | | | |
|---|---|---|---|
| JP | 2000-344372 | A | 12/2000 |
| JP | 2001-088947 | A | 4/2001 |
| JP | 2002-073240 | A | 3/2002 |

* cited by examiner

*Primary Examiner* — Prasad Gokhale
(74) *Attorney, Agent, or Firm* — John Victor Pezdek

(57) ABSTRACT

A removable media dam for a media input tray. The removable media dam is mountable in a front wall of the media tray and may contain one or more rollers for feeding media from the media input tray. The removable media dam includes a separator roll positioner for angularly rotating a separator roll between a retracted position and an extended position to adjust the height of the separator roll with respect to a media contact surface thereby varying the media sheet separation force applied by the separator roll to media sheets being fed from the media tray. In one form, the removable media dam is mountable by a user without the use of tools.

32 Claims, 20 Drawing Sheets

REMOVABLE MEDIA DAM WITH SEPARATOR ROLL POSITIONER FOR A MEDIA TRAY

CROSS REFERENCES TO RELATED APPLICATIONS

This application is related to U.S. patent application Ser. No. 13/857,331, entitled "METHOD OF USING SEPARATOR ROLL POSITIONER IN A REMOVABLE MEDIA DAM AND SEPARATOR ROLL SPEED TO CORRECT MEDIA FEED ERRORS," filed Apr. 5, 2013, and assigned to the assignee of the present application.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The field relates generally to media input trays for an image forming device ("image forming device") having a removable input tray, and, in particular, to media dams having separator rolls found in such trays.

2. Description of the Related Art

Image forming devices, such as printers, scanners and photocopiers utilize media feed mechanisms for feeding various types of media sheets into the image forming devices. Examples of the various types of media sheets include, but are not limited to, printing paper, bond paper, coated paper, fabrics, transparencies and labels. Almost all of the media feed mechanisms include a pick roll that feeds a media sheet into the image forming device for further processing. In a media feed mechanism, various arrangements of the pick roll may exist for feeding the media sheet into the image forming device.

Image forming devices typically include multiple input sources to introduce the media sheets into the media path. The input sources may accommodate a range of media types and a range of media sheet quantities from a single media sheet to large quantities such as 2,000 or more sheets. One type of input source is referred to as a removable media input tray ("removable media input tray") integrated within the same housing that contains the imaging units of the image forming device. A multi-purpose feeder may also be provided on the image forming device housing or as part of the integrated media tray for accommodating a low number of media sheets and often for specialty media sheets that are difficult to feed through normal input trays, such as envelopes, transparencies, and cardstock.

Another input source is referred to as an option assembly typically comprising a housing and a removable media input tray that is slidably received into the option housing. These option assemblies are typically stackable allowing one or more option assemblies to be used with a single image forming device which is typically positioned on top of the uppermost option assembly in the option assembly stack. Typically each option assembly may contain a different type of media such as letterhead or a different size such as A4 or a larger quantity of the same media type that is found in the integrated removable media input tray.

Each option assembly provides an extension to the media path of the image forming device and may provide one or more additional branches or avenues for introducing media into the media path of the image forming device. The media path extension extends from the top to the bottom of each option assembly and is upstream of the media path in the image forming device. When another option assembly is positioned below an option assembly, the media path extension permits media in the lower option assembly to be fed through the upper option assembly and into the media path of the image forming device that extends at its upstream end through the front portion of the integrated media tray. To accomplish the feeding of media either from a removable media input tray in an option assembly or from another option assembly, feed rollers have been provided in each option housing and in the media path extension to receive picked media either from a lower or inferior option assembly removable media input tray or from its own adjacent removable media input tray.

Included in each option assembly are a pick mechanism for moving media from the media tray, a media positioning mechanism and one or more drive motors for powering the pick mechanism, media positioning mechanism, and one or more adjustable media restraints such as a side restraint and a rear restraint to accommodate for different media widths and lengths. Further included are media sensors for determining when media is present in the tray, the size of the media and/or the location of the leading and trailing edges of the media.

Media trays have a media dam integrally formed in their front wall that is used to help direct the fed media into the media path. Typically such media dams are at an obtuse angle to the direction of the initial movement of the media being picked. Media dams are known to include wear strips on their front or face. Wear strips are slightly raised surfaces on the front face extending vertically along the surface of the media dam in contact with the picked media and help to decrease friction and aid in corrugating the fed media. Separator rollers are typically provided downstream of the media dam within the housing of the option assembly above the removable media input tray or in the image forming device above the removable media input tray therein. The separator rollers usually include a pair of opposed rollers, forming a nip therebetween, driven in the same direction so that one roll stops misfeed sheets while the other allows a topmost sheet to be fed. They are used to reduce the chance of media misfeeds such as multiple feeds and shingling.

A common problem in feeding a top or bottom sheet of media from a stack of media sheets is that the sheet being fed may stick together with at least one of next adjacent sheets and may be fed together at the same time. This problem is worse when feeding difficult-to-feed special media such as cardstock and labels. Labels are formed on a thick medium with numerous ridges and valleys that interlock from one sheet to the next, causing the sheets to stick together. Also, certain label materials, such as vinyl, tend to stick together.

The separator rolls may be in opposed pairs or may be unopposed rolls. In either case, a roll is mounted behind the media dam and has a portion projecting through the dam and out into the media path. A higher height would be more optimum for special media such as cardstock, envelopes, and labels, for example, while a lower height would be more optimum for the light weight media, such as onion skin, or sheets having a low intersheet friction such as bond or xerographic paper (collectively referred to as "light weight media"). The separator roll rotates counter to the media feed direction. When two sheets are fed by the pick mechanism from the media tray in a shingled manner, the top sheet hits the separator roll in a glancing manner and is driven by the pick mechanism up over the surface of the separator roll to continue along the media path. The lower or second sheet hits the separator roll more directly and is stopped.

In some instances, separator rollers of one type are changed out to another type depending on media type to be fed from the media tray. Because of their downstream location in the housing, this is at times an awkward process. To help with this problem, media dams that include the separator rollers that project a set distance out from the media dam and into the media path and that are removably mounted in the media tray have been created. Such removable media dams are easily uninstalled and reinstalled by a user, easily changing the type and configuration of the separator rolls. However such removable media dams have one drawback in that for a given media dam the amount that the separator rolls project into the media path is fixed. This means that a media dam configured for one type of media, such as lightweight media, would not be suitable or not reliably separate heavier weight media. This leads to the problem of whether to have a height of the separator rolls optimized for reliably separating heavy weight media or to have a height of the separator rolls optimized for reliably separating light weight media. Accordingly, users would have a variety of removable media dams available to handle different types and weights of media.

It would be advantageous to have a removable media dam where the amount of projection of the separator rolls can be adjusted allowing for separation of both heavy and light weight media. It would further be advantageous to have a removable media dam wherein the position of the separator rolls can be automatically adjusted.

SUMMARY OF THE INVENTION

Disclosed is a removable media input tray for a media feed device, comprising a bottom, a front wall, a rear wall and two side walls extending between the front and rear walls, the walls extending upwardly from the bottom, the walls and bottom defining a media storage location for holding media to be fed by the media feed device. The front wall has a front portion having a first height, a rearwardly extending top portion, two side portions extending rearward from the front portion and downward from the top portion and a rear portion, the rear portion extending vertically from the bottom to a second height that is less than the first height, the front portion, the top portion, the two side portions and the rear portion defining a cavity. A mount is disposed one of the side portions of the front wall. A removable media dam structure is removably mountable within the cavity in the front wall. The removable media dam comprises a top panel, a rear panel, a media contact surface having a top edge and a bottom edge and having an opening therethrough, and a pair of opposed side panels depending from the media contact surface, the top panel and the rear panel. The media contact surface extends between the side portions of the front wall with the top edge proximate the top panel and the bottom edge proximate the top of the back portion of the front wall. The pair of opposed side panels, the top panel, the rear panel and the media contact surface define a cavity. A mount is provided on one of the opposed side panels for removable engagement with the mount on one of the side portions of the front wall so that the media contact surface forms an obtuse angle with respect to the bottom of the tray when the removable media dam structure is mounted in the cavity in the front wall. A support is positioned within the cavity in removable media dam with the opening through the media contact surface positioned between the support and one side panel of the pair of opposed side panels.

A separator roll positioner is pivotally mounted between the support and the one side panel. The separator roll positioner includes a wheelset rotatably mounted therein and having an axis of rotation that is transverse to the two side walls of the media tray. The wheelset has an axle with a separator roll mounted thereon with an end of the axle being engageable with a drive source in the media feed device for axially rotating the wheel set. A flexible coupling and/or a clutch may be provided between the axle and drive source. The separator roll is aligned with and moveable through the opening in the media contact surface. Pivoting the separator roll positioner angularly rotates the separator roll to and maintains the separator roll at one of a retracted position, one or more intermediate positions and an extended position with respect to the media contact surface. When in the retracted position, a radial surface of the separator roll is at a first height with respect to the media contact surface. When in the extended position, the radial surface of the separator roll is at a second height with respect to the surface of the media contact surface that is greater than the first height. When in the one or more intermediate positions, the radial surface of the separator roll has respective heights that are greater than the first height and less than the second height. In one form when the separator roll is being adjusted between the retracted position and the extended position, the wheel set angularly rotates through a travel arc of approximately twenty-four degrees. The separator roll may be adjusted with the removable media dam being mounted in the media tray as well as when it is uninstalled. The separator roll positioner may be actuated and positioned by a user or by a positioner motor.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

DETAILED DESCRIPTION

Figure 1:
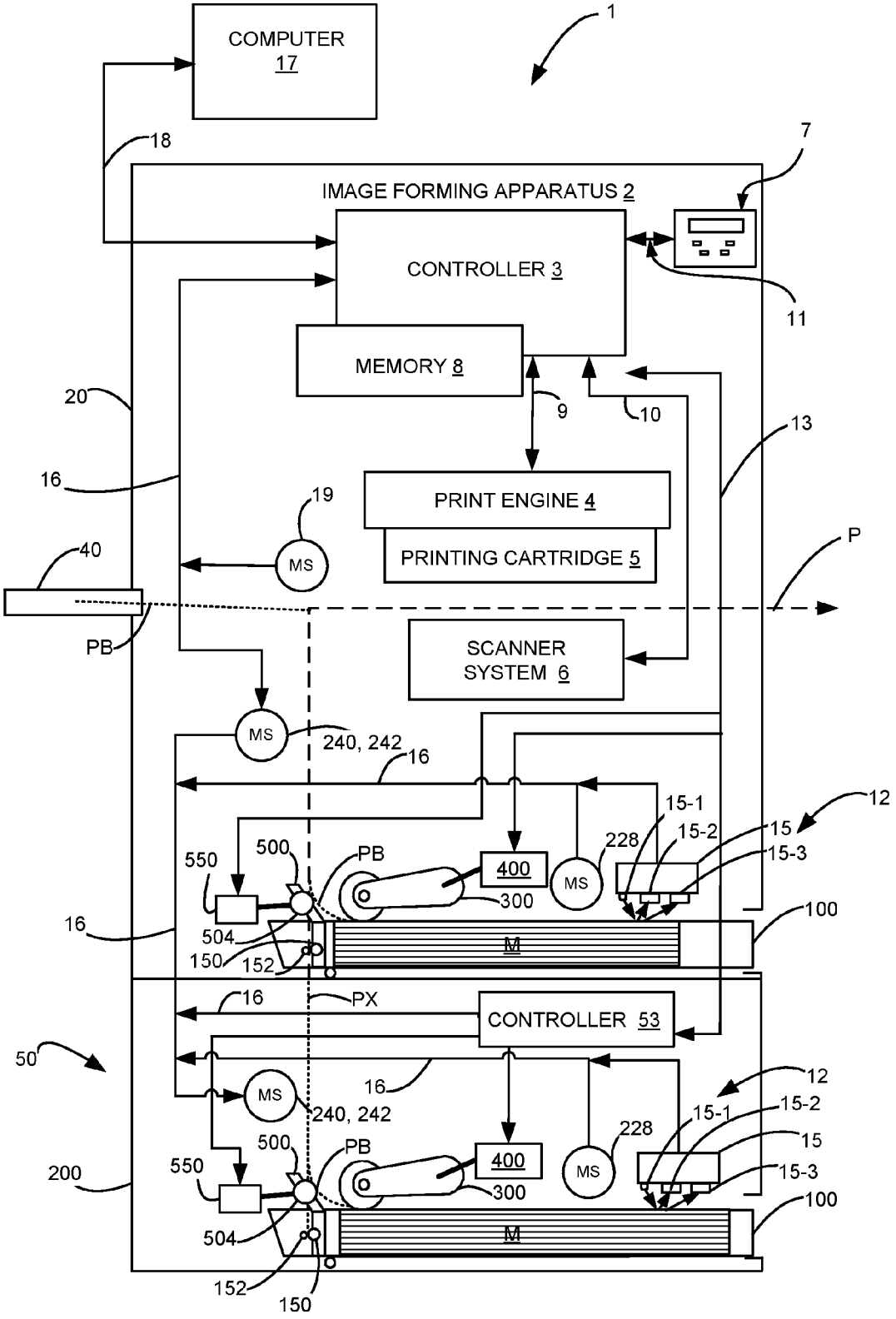
FIG. 1 is a schematic view of an imaging system according to one example embodiment.

It is to be understood that the present application is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this Detailed Description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and other alternative mechanical configurations are possible.

As used herein, the term "communication link" is used to generally refer to structure that facilitates electronic communication between multiple components, and may operate using wired or wireless technology. While several communication links are shown, it is understood that a single communication link may serve the same functions as the multiple communications link that are illustrated. As used herein, the term media width refers to the dimension of the media that is transverse to the direction of the media path. The term media length refers to the dimension of the media that is aligned to the direction of the media path. The media is said to move along the media path and the media path extensions from an upstream location to a downstream location as it moves from the media trays to the output area of the image forming apparatus. For each option tray, the top of the option tray is downstream from the bottom of the option tray. Conversely, the bottom of the option tray is upstream from the top of the option tray. Further, the media is conveyed using pairs of rolls that form nips therebetween. The term "nip" is used in the conventional sense to refer to a nip formed between two rolls that are located at about the same point in the media path. The rolls forming the nip may be separated apart, be tangent to each other, or form an interference fit with one another. With this nip type, the axes of the rolls are parallel to one another and are typically, but do not have to be, transverse to the media path. For example, a deskewing nip may be at an acute angle to the media feed path. The term "separated nip" refers to a nip formed between two rolls that are located at different points along the media path and have no common point of tangency with the media path. Again the axes of rotation of the rolls having a separated nip are parallel but are offset from one another along the media path. Nip gap refers to the space between two rolls. Nip gaps may be open, where there is an opening between the two rolls, zero where the two rolls are tangentially touching or negative where there is an interference between the two rolls. As used herein, the leading edge of the media is that edge which first enters the media path and the trailing edge of the media is that edge that last enters the media path. Depending on the orientation of the media in the media trays, the leading/trailing edges may be the short edge of the media or the long edge of the media, in that most media are rectangular. Further relative positional terms are used herein. For example, "superior" means that an element is above another element. Conversely "inferior" means that an element is below or beneath another element. "Media process direction" describes the movement of media within the imaging system as is generally meant to be from an input toward an output of the imaging system. The explanations of these terms along with the use of the terms "top," "bottom," "front," "rear," "left," "right," "up," and "down" are made to aid in understanding the spatial relationship of the various components and are not intended to be limiting.

Figure 2:
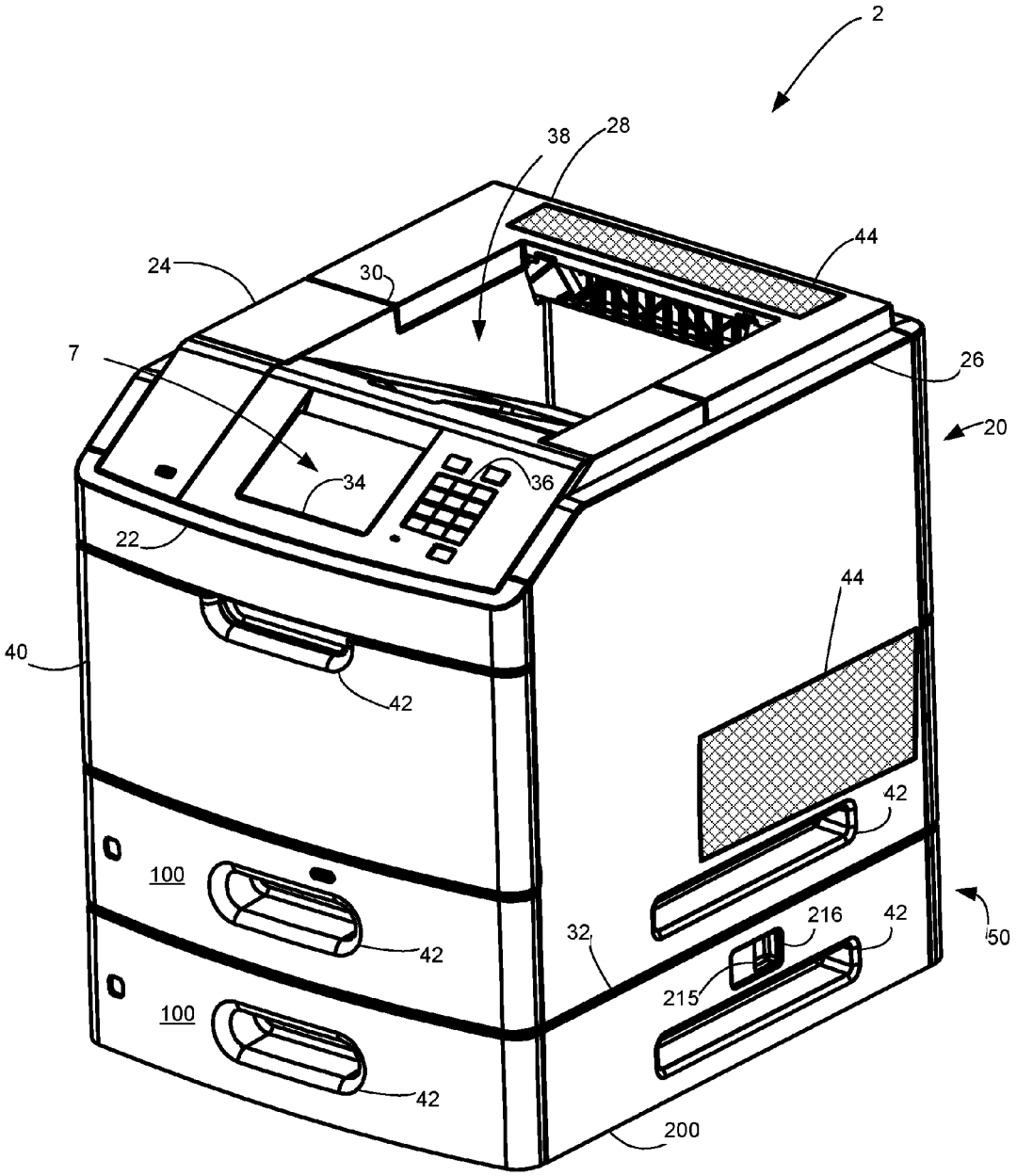
FIG. 2 is an illustration of the image forming device having a removable media input tray with an additional option assembly having a removable media input tray.

Referring now to the drawings and particularly to FIGS. 1-2, there is shown a diagrammatic depiction of an imaging system 1. As shown, imaging system 1 may include an image forming device 2, an optional computer 17 and/or one or more option assemblies 50 attached to the image forming device 2. Imaging system 1 may be, for example, a customer imaging system, or alternatively, a development tool used in imaging apparatus design. Image forming device 2 is shown as a multifunction machine that includes a controller 3, a print engine 4, a printing cartridge 5, a scanner system 6, and a user interface 7. Image forming device 2 may also be configured to be a printer without scanning. Image forming device 2 may communicate with computer 17 via communication link 18 using a standard communication protocol, such as for example, universal serial bus (USB), Ethernet or IEEE 802.xx. A multifunction machine is sometimes referred to in the art as an all-in-one (AIO) unit. Those skilled in the art will recognize that image forming device 2 may be, for example, an ink jet printer/copier; an electrophotographic printer/copier; a thermal transfer printer/copier; other mechanisms including at least scanner system 6 or a standalone scanner system.

Controller 3 includes a processor unit and associated memory 8, and may be formed as one or more Application Specific Integrated Circuits (ASIC). Memory 8 may be any volatile or non-volatile memory of combination thereof such as, for example, random access memory (RAM), read only memory (ROM), flash memory and/or non-volatile RAM (NVRAM). Alternatively, memory 8 may be in the form of a separate electronic memory (e.g., RAM, ROM, and/or NVRAM), a hard drive, a CD or DVD drive, or any memory device convenient for use with controller 3. In one embodiment, controller 3 communicates with print engine 4 via a communication link 9. Controller 3 communicates with scanner system 6 via a communication link 10. User interface 7 is communicatively coupled to controller 3 via a communication link 11. User interface 7 may include firmware maintained in memory 8 which may be performed by controller 3 or another processing element. Controller 3 may be, for example, a combined printer and scanner controller. Controller 3 serves to process print data and to operate print engine 4 during printing, as well as to operate scanner system 6 and process data obtained via scanner system 6. Controller 3 may also be connected to a computer 17 via a communication link 18 where status indications and messages regarding the media and image forming device 2 may be displayed and from which operating commands may be received. Computer 17 may be located nearby image forming device 2 or remotely connected to image forming device 2. In some circumstances, it may be desirable to operate image forming device 2 in a standalone mode. In the standalone mode, image forming device 2 is capable of functioning without a computer.

Controller 3 also communicates with a controller 53, via communication links 13 and 16, provided within each attached option assembly 50. Controller 53 operates various motors housed within option assembly 50 that position media for feeding, feed media from media path branches PB into media path P or media path extensions PX as well as feed media along media path extensions PX and media path P and control the travel of media along media path P and media path extensions PX.

As used herein, the term "communication link" generally refers to a structure that facilitates electronic communication between two components, and may operate using wired or wireless technology. Accordingly, a communication link may be a direct electrical wired connection, a direct wireless connection (e.g., infrared or r.f.), or a network connection (wired or wireless), such as for example, an Ethernet local area network (LAN) or a wireless networking standard, such as IEEE 802.11.

Image forming apparatus 2 and option assembly 50 each also include a media feed system 12 having a pick mechanism 300, a drive assembly 400 and removable media input tray 100 for holding media M to be printed or scanned and also having a media dam assembly 500 including a separator roll 504 and a separator roll positioner 550. In image forming apparatus 2, pick mechanism 300 is mechanically coupled to drive assembly 400 that is controlled by controller 3 via communication link 13. In option assembly 50, pick mechanism 300 is mechanically coupled to drive assembly 400 that is controlled by controller 3 via controller 53. In both image forming apparatus 2 and option assembly 50, pick mechanism 300 is used to drive a topmost sheet from the media stack into media dam 500 which directs the picked sheet into media path P or extension PX. In image forming apparatus 2, a media path P (shown in dashed line) is provided from removable media input tray 100 extending through the printing engine 4 and scanner system 6 to an output area, to a duplexing path or to various finishing devices. Media path P may also have extensions PX and/or branches PB (shown in dotted line) from or to other removable media input trays as described herein such as that shown in option assembly 50. Media path P may include a multipurpose input tray 40 and corresponding path branch PB that merges with the media path P within image forming apparatus 2. Along the media path P and its extensions PX are provided media sensors 240, 242 which are used to detect the position of the media, usually the leading and trailing edges of the media, as it moves along the media path P. Media type sensors 15 are provided in image forming device 2 and each option assembly 50 to sense the type of media being feed from removable media input tray 100. Media type sensor 15 has a light source 15-1, such as an LED 15-1 and two photoreceptors, 15-2, 15-3. Photoreceptor 15-2 is aligned with the angle of reflection of the light rays from LED 15-1. Photoreceptor 15-2 receives specular light reflected from the surface of the sheet of media and produces an output signal related to amount of specular light reflected. Photoreceptor 15-3 is positioned off of the angle of reflection to receive diffuse light reflected from the surface of the media and produces an output related to the amount of diffused light received. Controller 3 by rationing the output signals of photoreceptors 15-2, 15-3, can determine the type of media.

Media sensors 228 are provided in image forming device 2 and each option assembly 50 to sense the size of media being feed from removable media input tray 100. Media sensors 240, 242 positioned along media path P and its extension PX and media sensors 15, 228 are shown in communication with controller 3 via communication link 16. Media sensor 240 senses media along media path P and extension PX while media sensor 242 senses media along path branch PB that is being picked from media storage area 140 of the internal removable media input tray 100. Downstream of removable media input tray 100 in image forming apparatus 2, a media sensor 19, communicatively coupled to controller 3 via communication link 16, is positioned along the media path P to sense the presence of, as well as the leading and trailing edges of, media being fed from multipurpose input tray 40, from removable media input tray 100 within image forming apparatus 2 as well as media being fed from an option assembly 50.

FIG. 2 illustrates image forming apparatus 2 that includes the removable media input tray 100 that is integrated into a lower portion of the housing 20 of image forming apparatus 2. Housing 20 has a front 22, first and second sides 24, 26, rear 28, top 30 and bottom 32. User interface 7 comprising a display 34 and a key panel 36 may be located on the front 22 of housing 20. Using the user interface 7, a user is able to enter commands and generally control the operation of the image forming apparatus 2. For example, the user may enter commands to switch modes (e.g., color mode, monochrome mode), view the number of images printed, take the image forming apparatus 2 on/off line to perform periodic maintenance, and the like. A media output area 38 is provided in the top 30. A multipurpose media input tray 40 folds out from the front 22 of housing 20 which may be used for handling envelopes, index cards or other media for which only a small number of media will be printed. Hand grips 42 are provided in several locations on housing 20, such as on sides 24, 26, along the top of multipurpose media tray 40, and on the front of removable media input tray 100. Also various ventilation openings, such as vents 44 are provided at locations on first and second sides 24, 26 and top 30.

FIG. 2 also illustrates image forming apparatus 2 having an option assembly 50 comprising a removable media input tray 100, a housing 200 in which removable media input tray 100, pick mechanism 300, drive mechanism 400, and media dam assembly 500 and separator roll positioner 550 are contained. Image forming apparatus 2 is at the top of the stack and sits on top of option assembly 50. Latches and alignment features are provided as described herein between adjacent units. An adjacent unit is either an image forming apparatus 2 or another option assembly 50. Additional option assemblies 50 may be added to the stack between the attached option assembly 50 or below it. As each option assembly 50 is added, an extension PX to the media path P is also added. The media path extension PX within each option assembly 50 is comprised of two branches which eventually merge at a point above their respective housing 200, either, depending on location within the stack, within a superior option assembly 50 or within image forming device 2 itself.

Media sheets M are introduced from removable media input tray 100 and moved along the media path P and or a path extension PX during the image formation process. Each removable media input tray 100 is sized to contain a stack of media sheets M that will receive color and/or monochrome image. When used for feeding media sheets to a scanner, removable media input tray 100 would contain media sheets having images that would be scanned. Each image forming apparatus 2 may include one or more input options for introducing the media sheets. Each removable media input tray 100 may have the same or similar features. Each removable media input tray 100 may be sized to hold the same number of media sheets or may be sized to hold different quantities of media sheets. In some instances, the removable media input tray 100 found in image forming apparatus 2 may hold a lesser, equal or greater quantity of media than a removable media input tray 100 found in an option assembly 50. As illustrated removable media input tray 100 is sized to hold approximately 550 pages of 20 pound media which has a media stack height of about 59 mm and at this stack height would be considered full. For lighter or heavier weight media, the number of pages with this stack height would of course vary depending on the thickness of the media. If additional media were added, removable media input tray 100 would be considered to be overfilled. Typically, removable media input tray 100 in option assembly 50 is insertable into a housing 200 of another option assembly 50, but this is not a requirement or limitation of the design.

Figure 3:
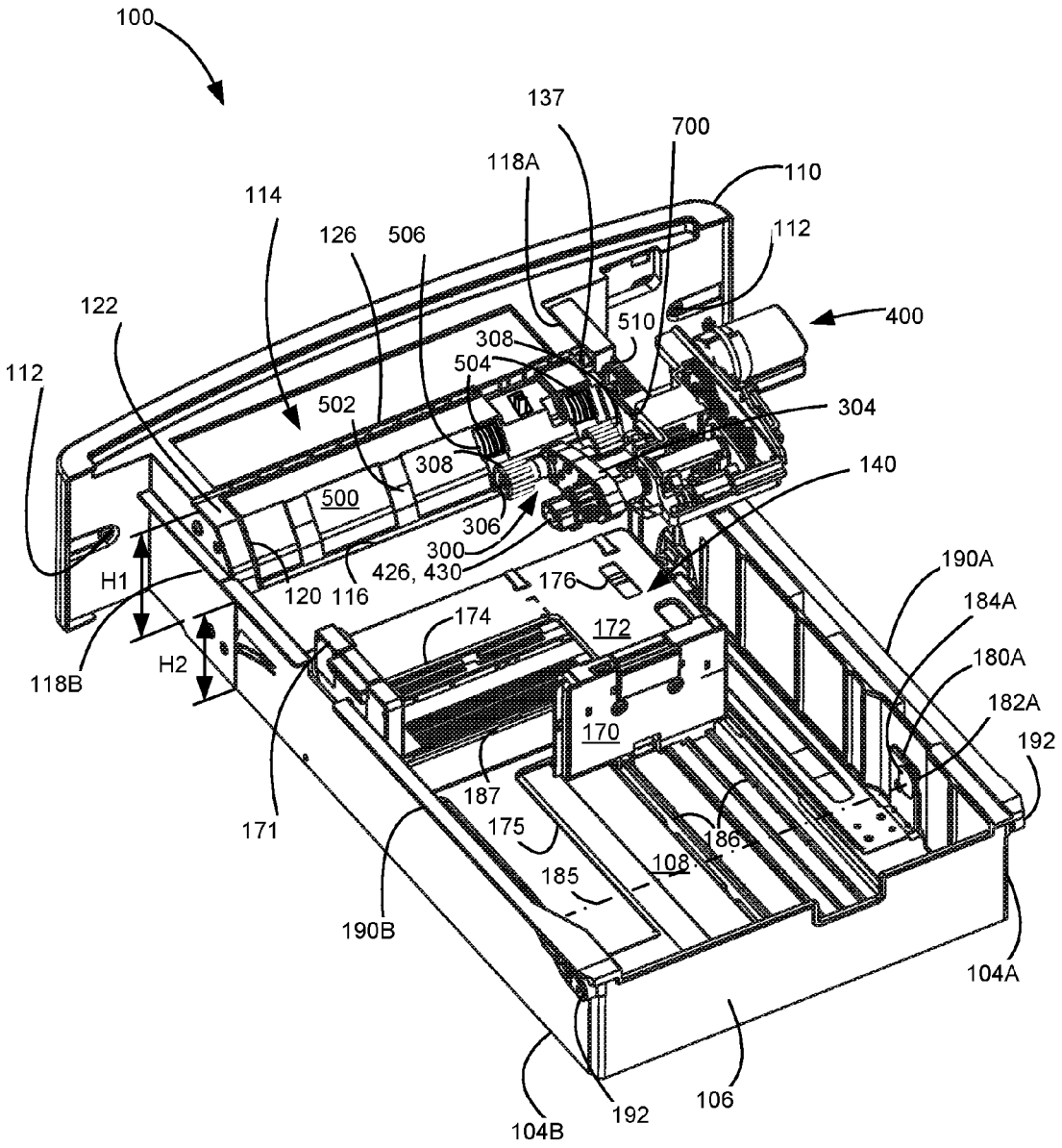
FIG. 3 is a perspective illustration of a removable media input tray found in one of the imaging system or option assembly along with a media feed system.
Figure 4:
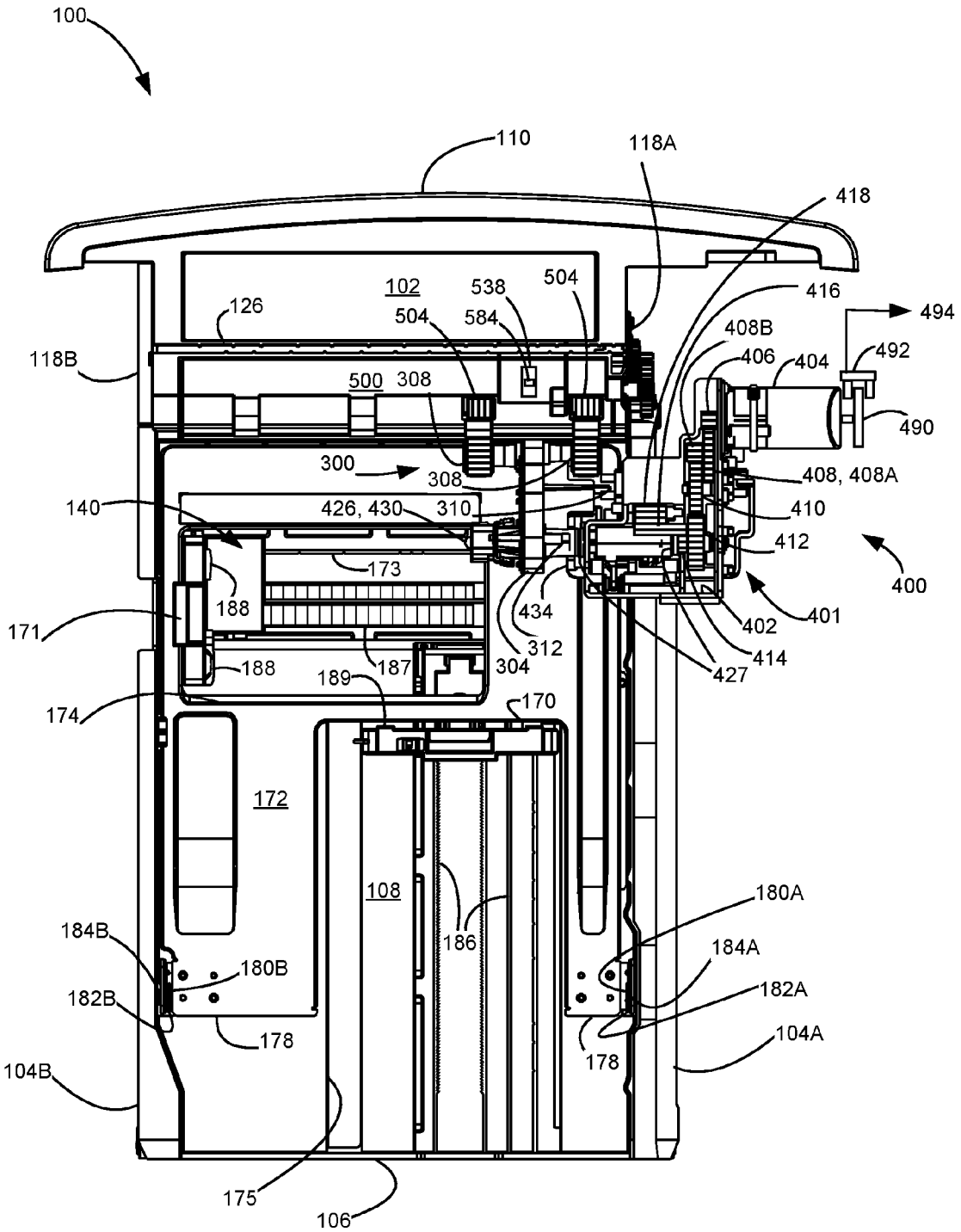
FIG. 4 is a plan view of the removable media input tray and a media feed system shown in FIG. 3.

Referring to FIGS. 3-4, removable media input tray 100 has a front wall 102, side walls 104A, 104B, a rear wall 106, and a bottom 108. Attached to a front surface of front wall 102 is panel 110 having hand grip 42 therein (See FIG. 2). Panel 110 is illustrated as being attached to front wall 102 by fasteners 112. Front wall 102 may be further defined by front portion 114 having a height H1, a rear portion 116 spaced apart from front portion 114 and having a height H2 that is less than height H1, with side portions 118A, 118B adjacent side walls 104A, 104B, respectively, connecting front and rear portions 114 and 116 defining a cavity 120, and a top portion 122. In one embodiment, media dam 500, having a separator roll positioner 550, is removable and received into cavity 120 and is attached to a mount provided in front wall 102 and contains, in some embodiments, a pair of spaced apart separator rolls 504 projecting through corresponding openings 506 in the surface of media dam 500 or in the media contact surface 502 with separator roll positioner being used to adjust the amount of projection of separator rolls 504. In other embodiments, a fixed sloped media dam having positioner 550 and a media contact surface 502 extends from the top of rear portion 116 to the top portion 122 of front wall 102 and between side portions 118A, 118B of front wall 102 and may be molded into front wall 102. The fixed version of media dam may also contain openings 506 through which a portion of one or more separator rolls 504 extend and a positioner 550 mounted behind the surface where positioner 550 may be used to adjust the extent to which separators rolls 504 may project into the media path branch of the removable media input tray 100. Also in either of these embodiments media contact surface 502 forms an obtuse angle with the bottom 108 of removable media input tray 100. The combination of rear portion 116 and media contact surface 502 may also be referred to as a media dam having a vertical portion (rear portion 116) and an angled or sloped portion having media contact surface 502 thereon. In front of a media dam, such as removable media dam 500, a channel 126 is provided to allow for media M to pass through removable media input tray 100 from an inferior unit to a superior unit.

Rearward of front wall 102 is media storage location 140 for media that will be fed to image forming device 2 and is generally defined by front wall 102 and side walls 104A, 104B and bottom 108. As illustrated, rear wall 106 encloses media storage location 140. Alternate embodiments of removable media input tray 100 may not include a rear wall 106. Media storage location 140 may be open or enclosed. Within media storage location 140 are rear and side media restraints 170, 171, lift plate 172, and lift arm 173. Media M to be fed is placed on lift plate 172 which is positioned between side walls 104A, 104B and is dimensioned to hold the widest media for which removable media input tray 100 is designed to hold. As illustrated, the length of lift plate 172 is shorter than the length of the longest media for which removable media input tray 100 is designed in that most media have a modicum of pliability. Example media sizes include, but are not limited to, A6, A4, A3, Letter, Legal, and Ledger. Lift arm 173 is positioned beneath lift plate 172 and is connected to drive mechanism 400. Lift arm 173 extends through side wall 104A toward side wall 104B and is used to elevate lift plate 172 and media M up to pick mechanism 300 for feeding media M into media path P. Openings 174, 175 are provided in lift plate 172 to accommodate the adjustment of rear and side media restraints 170, 171, which are slidably attached to bottom 108, while allowing lift plate 172 to be raised or lowered. Provided near the rear end 178 of the lift plate 172 are a pair of opposed pivot arms 180A, 180B that extend vertically upward from the lift plate 172 parallel to side walls 104A, 104B, respectively. Openings 182A, 182B are provided adjacent the upper ends of pivot arms 180A, 180B, respectively, which are received on corresponding bearing posts 184A, 184B provided on side walls 104A, 104B, respectively. The use of the pivot arms 180A, 180B raises a pivot axis 185 of lift plate 172 from the bottom 108 to about the centerline of bearing posts 184A, 184B, a distance of about 30 mm. When media storage location 140 is at capacity, this places the leading edge of the top-most media proximate the top of rear portion 116. The location of axis 185 may be designed such that it would be approximately at the mid-point of the rated capacity for the removable media input tray 100. For example, if a filled removable media input tray 100 is designed to hold a media stack of about 50 mm in height then pivot axis 185 would be located at about 25 mm from the top surface of lift plate 172. Raising pivot axis 185 of lift plate 172 (see FIG. 3) reduces the amount of fanning or shingling that occurs in the leading edges of media M as it is raised up to pick mechanism 300 for feeding and provides near straight-line motion of the leading edges of the media M. However other locations for the pivot axis 185 may also be used with media dam 500.

Media restraints 170, 171 are adjustable and lockable within tracks 186, 187 provided in bottom 108 to accommodate various lengths and widths of media in removable media input tray 100. Track 186 allows rear media restraint 170 to move from a distal position near rear wall 106 to a proximal position approximately midway along side walls 104A, 104B. Track 187 allows side media restraint 171 to laterally move from a position adjacent side wall 104B to a position approximately 80 mm from side wall 104A. This allows removable media input tray 100 to hold a narrow compressible media such as envelopes for feeding. Side media restraint 171 has at least one vertically extending media biasing member 188 to bias a topmost portion of the media toward a side wall 104A for aligning media to the media path P and media edge reference surface 700. Biasing member 188 may extend the height of side media restraint 171 or may extend only a portion of its height. Rear media restraint 170 has a spring-bias angled plate 189 that abuts the trailing edges of the media and angles or rotates outwardly from the bottom of rear media restraint 170 while pivoting about an axis near the top of angled plate 189. Angled plate 189 helps to reduce fanning or shingling of the leading edges of media M as it is elevated into picking position within housing 20 or housing 200 by applying greater biasing on the lower portion of the media to the media process direction than at the top of angled plate 189.

Guide rails 190A, 190B are also provided on the side walls 104A, 104B, respectively, in addition to guide rollers 192 located on the distal end of side walls 104A, 104B near rear wall 106 to assist with insertion and removal of removable media input tray 100 from housing 20 or housing 200. For purposes of clarity, also shown in FIGS. 3-4 are pick mechanism 300 and drive mechanism 400 and their relation to removable media input tray 100 when installed in housing 200. As illustrated, pick mechanism 300 is connected to and supported by drive mechanism 400. Drive mechanism 400 is mounted within housing 200. Drive mechanism 400 is also provided in housing 20. Other mounting configurations for pick mechanism 300 may also be used.

Figure 5:
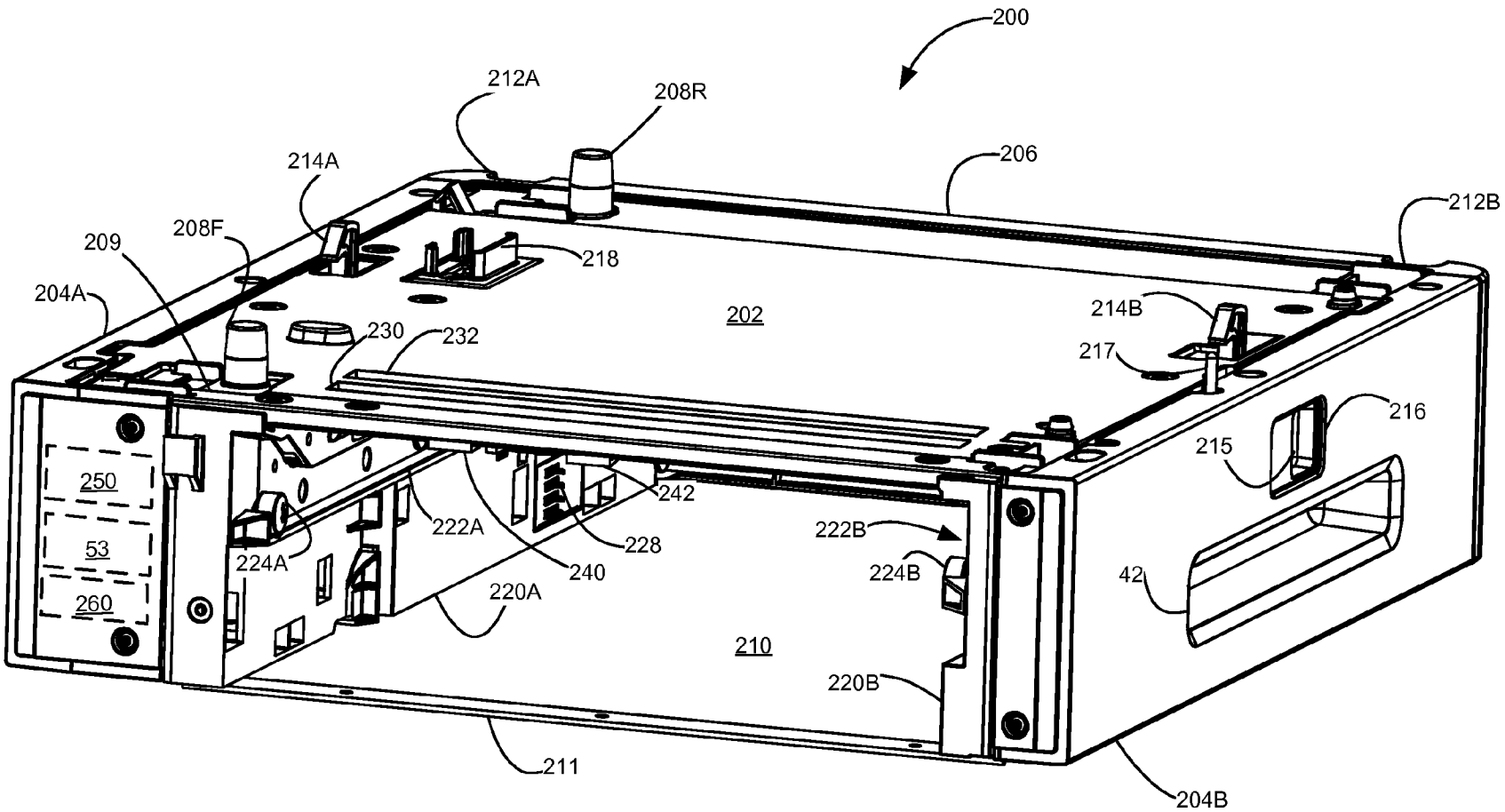
FIG. 5 is a perspective view of the option assembly housing for receiving the removable media input tray of FIG. 3.

Housing 200 for option assembly 50 is illustrated in FIG. 5. As illustrated, housing 200 comprises a top 202, generally parallel sides 204A, 204B, and a back 206. Top 202 is fastened to side walls 204A, 204B by fasteners such as screws. Front and rear alignment posts 208F, 208R extend vertically from the top of side wall 204A and are aligned with one another so that a line drawn between them would to be parallel with side 204A. As illustrated posts 208F, 208R extend about 25 mm upwardly from top 202. Front alignment post 208F is provided on a plate 209 that fastens to the top of side wall 204A. Rear alignment post 208R is molded as part of side wall 204A. Front and rear alignment holes (not shown) are molded into and extend vertically from the bottom of side wall 204A and are aligned with alignment posts 208F, 208R and receive alignment posts from an inferior option assembly. Front and rear alignment posts 208F, 208R are received into corresponding front and rear alignment holes 210F, 210R in the superior unit, either another option assembly 50 or image forming apparatus 2. The upper ends of alignment posts 208F, 208R are tapered to provide for easier insertion. Hand grips 42 are provided in the exterior portion of side walls 204A, 204B. The bottom of housing 200 is an opening 210 generally defined by sides 204A, 204B and back 206. A support 211 extends between the lower proximal ends of side walls 204A, 204B to maintain the parallelism between side walls 204A, 204B and define a front edge of opening 210. Rear wall 206 is provided with a pair of vertical channels 212A, 212B, each located near sidewalls 204A, 204B, respectively. Channels 212A, 212B serve as wire ways for cabling.

Spring-biased hooks 214A, 214B extend vertically from the top of side walls 204A, 204B, respectively, and serve as latches to secure option assembly 50 to the superior unit. Corresponding latch holes are provided in the bottom of side walls 204A, 204B of each option assembly 50 and in bottom 32 of housing 20. As a superior unit, e.g., image forming apparatus 2 or another option assembly 50 is lowered onto top of housing 200, spring-biased hooks 214A, 214B automatically engage with corresponding latch holes in the unit being installed locking the unit into position on top of housing 200. A spring-biased release actuator 215 is provided in recess 216 on one or both of side walls 204A, 204B. As shown, release actuator 215 is in side wall 204B. Adjacent hook 214B is a spring-biased rod 217 vertically mounted within one or both of side walls 204B. As illustrated rod 217 is mounted in side wall 204B. When a superior unit is mounted on top of housing 200 and is properly situated, rod 217 will be depressed into side wall 204B and hooks 214A, 214B will be engaged with the superior unit. To remove an installed superior unit, a user pulls or slides release actuator 215 against its bias spring toward the front of housing 200 which rotates hooks 214A, 214B toward rear wall 206 lowering hooks 214A, 214B and disengaging hooks 214A, 214B from the upper unit. At the same time an end of rod 217 within side wall 204B engages a detent or recess in release actuator 215 and retains release actuator 215 keeping hooks 214A, 214B in a lower unengaged position allowing the superior unit to be lifted off by a single user. As the superior unit is lifted, rod 217 rises due to the spring biasing and releases actuator 215 which springs back to its starting position. In turn hooks 214A and 214B spring back to a vertical position ready to be reengaged when an upper unit is again placed on housing 200. A second rod, a second recess and a second actuator similar to rod 217, recess 216 and actuator 215, may be provided in side wall 204A.

In side wall 204A, on both its top and bottom is an electrical connector 218 that will allow for communications links 13 and 16 to be extended into and through each option assembly as it is added. As shown a male electrical connection is shown on the top of side wall 204A. A female electrical connector (not shown) is provided on the bottom of side wall 204A and in bottom 32 of housing 20. In one embodiment a drive motor 260 for separator roll positioner 550 may be housed in or on side wall 204A. In addition, controller 53 is provided in option assembly 50. Controller 53 is housed in or on side wall 204A and is in communication with controller 3 in image forming device 2 via communications links 13, 16 and the various sensors 15, 228, 240, 242, 492. Controller 53 also controls operation of motors 250, 260 and 404.

Drive mechanism 400 and pick assembly 300 are also mounted to side wall 204A below top 202. On interior portions 220A, 220B of side walls 204A, 204B, guide tracks 222A, 222B, respectively, and guide rollers 224A, 224B, respectively, are provided and cooperatively engage guide rails 190A, 190B on removable media input tray 100 and provide support therefor when it is installed. Media size sensor 228 is also positioned on interior portion 220A. Media size sensor 228 is also provided in housing 20 for use with the removable media input tray 100 that is integrated in housing 20. As shown, media size sensor 228 comprises four switches that are each actuated by a corresponding actuator located on side wall 104A of removable media input tray 100. The actuators are each in turn operated by mechanical linkages that move when rear media restraint 170 is positioned along track 186 within removable media input tray 100. The state of the switches in media size sensor 228 provides a binary signal to controllers 3, 53 allowing for up to 16 different media lengths to be sensed. Once media length is sensed, controller 3, 53 associates a media width for a given length. For example if the length sensed is 11 inches (Letter media) then the associated media width would be 8.5 inches. Similar associations are programmed for other commonly used media such as A6, A4, A3, Legal, and Ledger. A drive motor 250, also termed a feed motor, for driving separator roller 504 and feed roller 150 is also housed within a recess in side wall 204A. Drive motor 250 drives an axle gear 510 which via a pivot gear 158 drives feed gear 160 of feed roller 150 (see FIG. 8A).

Provided in top 202 are a pair of parallel slots 230, 232 that extend between side walls 204A, 204B that allow for the feeding of media M through channel 126 or feeding of media passing over media contact surface 502 from storage location 140, respectively. In one embodiment the ends of slots 230, 232 adjacent side wall 204A are formed by a vertical portion of a plate mounted to side wall 204A below top 202 to form a reference guide surface. Media sensors 240, 242 are provided for slots 230, 232, respectively and are mounted underneath top 202. Media sensors 240, 242 detect the presence of, as well as, the leading and trailing edges of media passing through slots 230, 232, respectively. Media sensor 240 is also referred to as the feed through sensor as it senses media moving in channel 126 while media sensor 242 is referred to as a pick sensor as it senses media being pick from media storage location 140. While specific locations for various elements have been set forth, those locations may be changed. For example, pick mechanism 300 or drive mechanism 400 mounted in or on side wall 104A or may be mounted on the opposite side wall, 104B, 204B respectively and is a matter of design choice to one of skill in the art.

Pick mechanism 300 is mounted to drive mechanism 400 on pick drive shaft 426 which as shown is a cantilevered shaft having a free end 430. Alternatively, pick drive shaft 426 may extend to and be received in a mount on side wall 204B. In the embodiment shown in FIGS. 3-4, pick mechanism 300 is detachably mountable on pick drive shaft 426. The terms such as top, bottom, front and rear of pick mechanism 300 are dependent on its orientation. As used in this description of pick mechanism 300, the terms top, bottom, front and rear refer to the orientation of pick mechanism 300 as illustrated in FIGS. 3-4. A drive transmission 304 is at one end operatively connected to pick drive shaft 426 extending from drive mechanism 400 mounted on housing 20 of image forming device 2 or housing 200 of option assembly 50. At its other end, drive transmission 304 is coupled to a pick axle 306 having a pick wheel 308 mounted at each end. Other configurations of pick wheels may also be used. For example, a single pick wheel or three pick wheels may be mounted on pick axle 306. In operation, when pick drive shaft 426 is rotated, torque is transferred through to drive transmission 304 to pick axle 306 which drives pick wheels 308.

A stop 312 extends from the transmission 304 for limiting the rotation of the pick mechanism 300 about drive shaft 426. A frame 402 of the drive mechanism 400 includes an abutment 434 disposed adjacent to the pick mechanism 300 such that when the pick mechanism 300 rotates beyond a predetermined point, stop 312 contacts abutment 434 thereby limiting either the upward or downward rotation of the pick mechanism 300 about pick drive shaft 426. In some embodiments, a pair of diametrically opposed stops 312 extend from the transmission 304 such that stops 312 limit both the upward and downward rotation of the pick mechanism 300 about the pick drive shaft 426. The combination of stops 312 and abutment 434 limit the total upward and downward motion of pick mechanism 300 to an arc of about 23 degrees. In other designs, pick mechanism 300 may have about 140 to 160 degrees of rotation motion.

Frame 402 mounted to housing 20 or housing 200 supports drive mechanism 400. Drive mechanism 400 includes a common motor 404 that drives pick mechanism 300 and lifts lift plate 172. Drive transmission 401 is shown having a single input connected to motor 404 via gear 408. Drive transmission 401 includes a first output that drives pick drive shaft 426 connected to pick mechanism 300 and a second output connected to lift plate 172 through intermediate gearing that is used to raise lift plate 172. While the example embodiment shown includes two outputs, additional outputs may be provided as desired for performing additional functions.

A drive pinion 406 extends from motor 404 and connects to drive transmission 401 to transfer rotational force from motor 404 to drive transmission 401. In the example embodiment shown, drive pinion 406 is connected to a speed reducer dual gear 408 that includes a larger portion 408A and smaller portion 408B. Pinion 406 is connected to larger portion 408A while smaller portion 408B is connected to an intermediary gear 410. It will be appreciated that in this configuration, the rotational speed of intermediary gear 410 is less than the rotational speed of motor 404 and drive pinion 406 as a result of the difference between the circumferences of larger portion 408A and smaller portion 408B of speed reducer dual gear 408. Alternatives include those wherein the orientation of larger portion 408A and smaller portion 408B is reversed so that the rotational speed of intermediary gear 410 is greater than the rotational speed of motor 404 and drive pinion 406. Further alternatives include those wherein speed reducer dual gear 408 is replaced with a simple intermediary gear so that the rotational speed of intermediary gear 410 is the same as the rotational speed of motor 404 and drive pinion 406.

A pick mechanism drive gear 412 is connected to intermediary gear 410. Pick mechanism drive shaft 426 is substantially concentric with and extends from pick mechanism drive gear 412. Pick drive shaft 426 is positioned by a pair of bearing sleeves 427 relative to frame 402. Bearing sleeves 427 are each mounted in frame 402 and are disposed around pick drive shaft 426 so that pick drive shaft 426 is free to rotate. Pick mechanism 300 is removably mountable on free end 430 of pick drive shaft 426. When pick mechanism 300 is mounted on pick drive shaft 426, pick drive shaft 426 transfers rotational force to drive transmission 304 for driving pick wheels 308.

A first clutched gear 414 is positioned around pick drive shaft 426. A second clutched gear 416 is connected to first clutched gear 414 of drive transmission 401. First and second clutched gears 414, 416 each include a one-way clutch. In the example embodiment shown, second clutched gear 416 is connected to an intermediary gear 418 pivotally mounted on side wall 104A of the removable media input tray 100. Intermediary gear 418 is connected to a sector gear 422 via intermediary gear 420 (see FIG. 6) pivotally mounted in side wall 104A. An end of lift arm 173 is received in an opening 423 in mounted to sector gear 422. Lift arm 173 is slidably disposed between bottom 108 and a bottom surface of lift plate 172. Accordingly, rotation of sector gear 422 in one direction rotates lift arm 173 upward against the bottom surface thereby rotating lift plate 172 about pivot axis 185.

The engagement of first clutched gear 414 is opposite the engagement of second clutched gear 416. Clutched gears 414, 416 are configured so that when pick mechanism 300 is driven in the media process direction for feeding media M, lift plate 172 is held in place during feeding of media. When elevation of lift plate 172 is called for as media is removed during media feeding, motor 404 rotation is reversed raising lift plate 172 while reversing the rotation of pick mechanism 300 to be opposite the media process direction. In the example embodiment shown, when motor 404 drives the pick mechanism 300 in the media process direction, first clutched gear 414 is disengaged so that it does not rotate with drive shaft 426 and second clutched gear 416 is engaged to hold lift plate 172 in place. When motor 404 drives pick mechanism 300 opposite the media process direction, first clutched gear 414 is engaged so that it rotates with drive shaft 426 as it is driven by motor 404 and second clutched gear 416 is disengaged and driven by first clutched gear 414 to rotate sector gear 422. Rotation of the sector gear 422 raises lift arm 173 and, in turn, raises lift plate 172.

Motor 404 includes an encoder wheel 490 that rotates with motor 404 providing encoder pulses indicative of the rotation of motor 404. As encoder wheel 490 rotates, an encoder wheel sensor 492 provides an output 494 in the form of pulses to controllers 3, 53 that allows controllers 3, 53 to track the rotation of encoder wheel 490 and motor 404 which may be used to track movement of lift plate 172 and rotation of pick mechanism 300.

In those embodiments where media dam 500 includes a substantially vertical wall portion proximate the media storage location 140 extending downward from the media dam 500, such as rear portion 116 of the front wall 102 (See FIG. 3), the downward rotation of the pick mechanism 300 is limited at a point above the intersection between the inclined portion of media dam 500 and the substantially vertical wall portion. This ensures that when the media is fed by the pick mechanism 300, it is able to ascend the motor contact surface 502 of media dam 500. If the media were fed below the intersection between the inclined portion of media dam 500 and the substantially vertical wall portion, the leading edge of the media would be fed directly into the substantially vertical wall portion which could result in a misfeed if the media is unable to ascend the substantially vertical wall portion and reach the inclined portion of media dam 500.

Each time removable media input tray 100 is removed from the housing 20 or housing 200, drive transmission 401 disconnects from the lift plate 172 causing it to fall to bottom 108 of removable media input tray 100. As a result, lift plate 172 is presented to the user in a consistent manner for re-filling each time removable media input tray 100 is removed regardless of the amount of media still remaining in removable media input tray 100. In the example embodiment shown, when removable media input tray 100 is removed, the connection between second clutched gear 416 and intermediary gear 418 in the side wall 104*a* is broken. As a result, each time removable media input tray 100 is reinserted into housing 20, 200 lift plate 172 must be lifted from bottom 108 of removable media input tray 100 until pick mechanism 300 reaches the maximum desired pick height.

Figure 6:
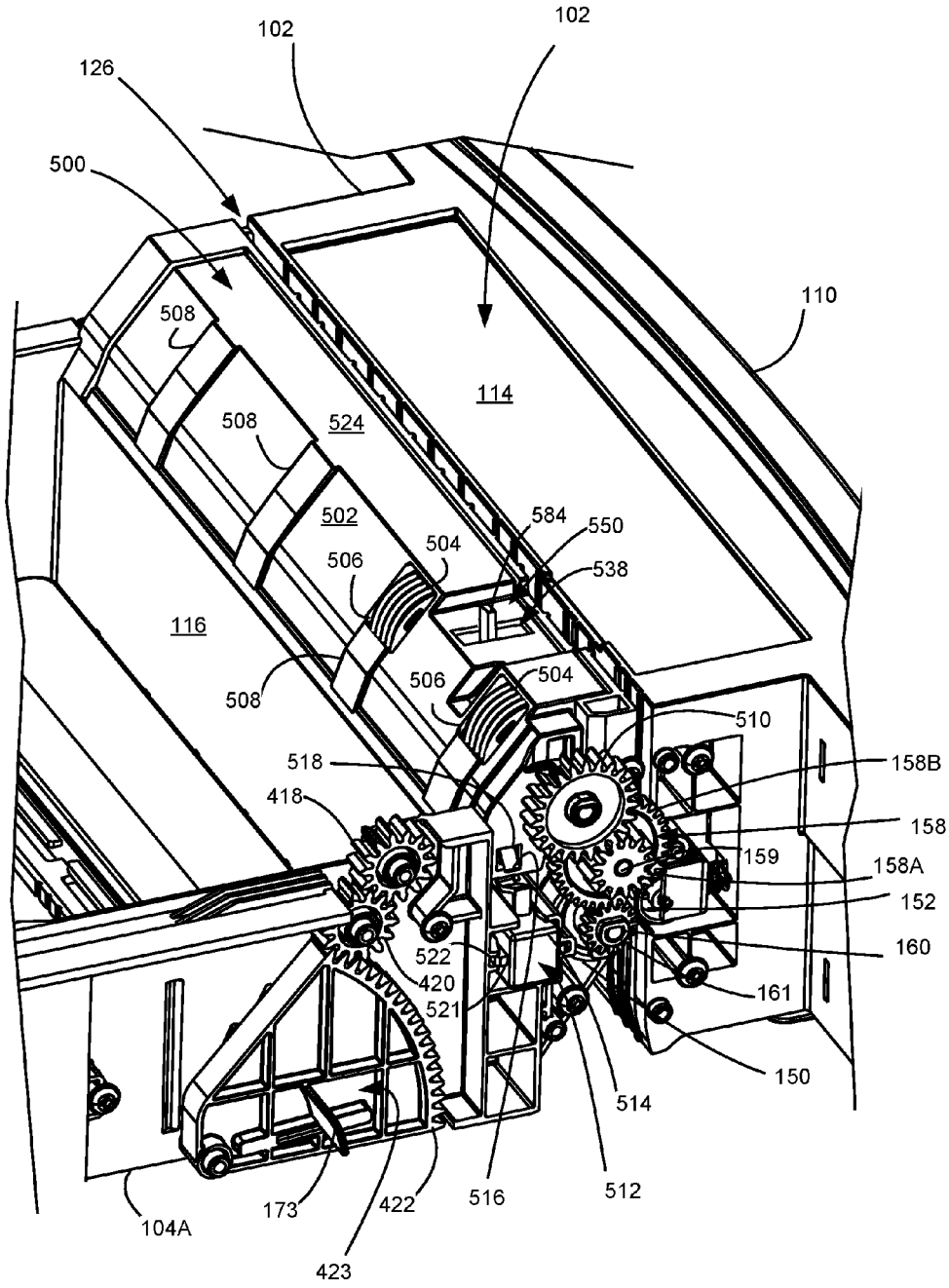
FIG. 6 is a partial perspective view illustrating a media dam with separator roll positioner installed in the removable media tray of FIG. 3.
Figure 7:
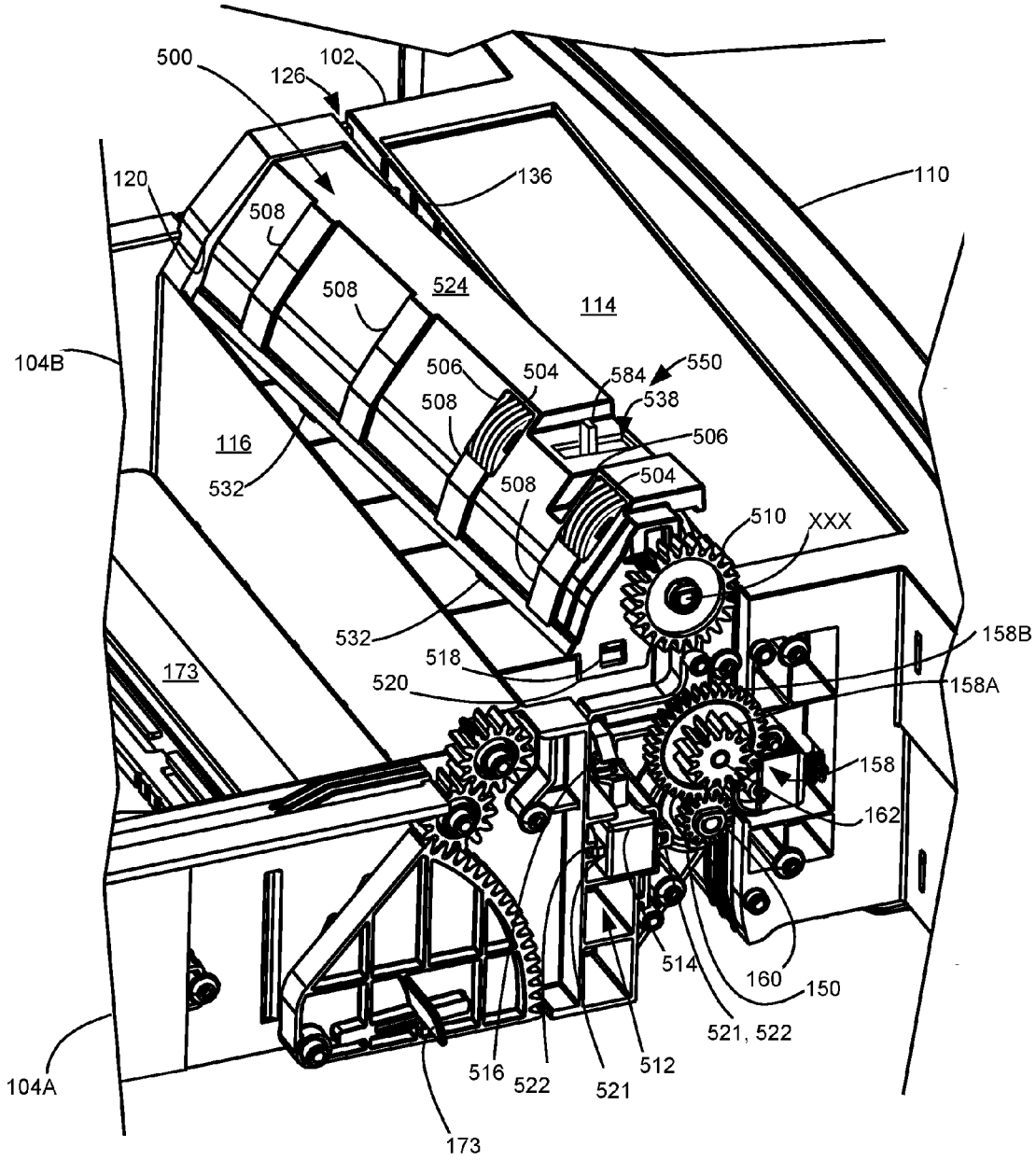
FIG. 7 is a partial perspective view illustrating the media dam with separator roll positioner being installed into the removable media tray of FIG. 3.

Referring to FIGS. 6-9, one embodiment of removable media dam 500 is illustrated. In FIG. 6, removable media dam 500 is shown mounted in cavity 120 in front wall 102 behind channel 126. Media dam 500 comprises an inclined front panel forming media contact surface 502, a top panel 524, a rear panel 526 and two side panels 520, 522 interconnecting media contact surface 502, top panel 524 and rear panel 526 and forming a cavity 528. Support ribs 530 are provided in at least a portion of cavity 528 to stiffen removable media dam 500. Tabs 532 extending from the bottom edge 531 of the front portion of media dam 500 slide in behind the upper edge of rear portion 116 to help stiffen rear portion 116. Rear panel 526 may also be used to form a portion of channel 126, if present, in removable media tray 100. Mounts are provided on both front wall 102 and on removable media dam 500 to allow for the detachable mounting of removable media dam 500 in removable media input tray 100.

A pair of spaced apart separator rolls 504 are rotatably mounted within cavity 528. A portion of the surface of each separator roll 504 radially extends through a corresponding opening 506 in media contact surface 502. When the media dam is molded into front wall 102, separator rolls are also provided as described for removable media dam 500. A plurality of slightly raised wear strips 508 are provided on media contact surface 502. The surfaces of wear strips 508 may have frictional features such as dimples, transverse ridges or steps molded therein or be provided in a member that is affixed to the surface of wear strips 508.

Separator roll positioner 550 is provided behind media contact surface 502, is pivotally mounted within a portion of cavity 528, and is used to angularly rotate separator rolls 504. Axle gear 510 is operably coupled to an axle on which separator rolls 504 are mounted. Separator rolls 504 are mounted within separator roll positioner 550 that is used to angularly rotate separator rolls 504 between a retracted position where separator rolls 504 are, in one example form, completely beneath the surface of media wear strips 508 and or contact surface 502 to a fully extended position allowing for a larger portion of the circumference of separator rolls 504 to project outwardly from media contact surface 502 and or wear strips 508. Axle gear 510 is also illustrated as being coupled to a pivot gear 158 that is mounted on shaft 159 that is mounted on side 104A of removable media tray 100. In one example form, pivot gear 158 may be a compound gear having a smaller diameter gear 158A that engages with axle gear 510 while larger diameter gear 158B engages with feed gear 160 mount on shaft 161 which drives feed roll 150 located in channel 126 of front wall 114. A backup roll 152 mounted on shaft 153 is biased against feed roll 150 by springs forming a nip therebetween. Feed roll 150 and backup roll 152 are used to move media being fed through channel 126 from a lower option assembly.

Figure 8A:
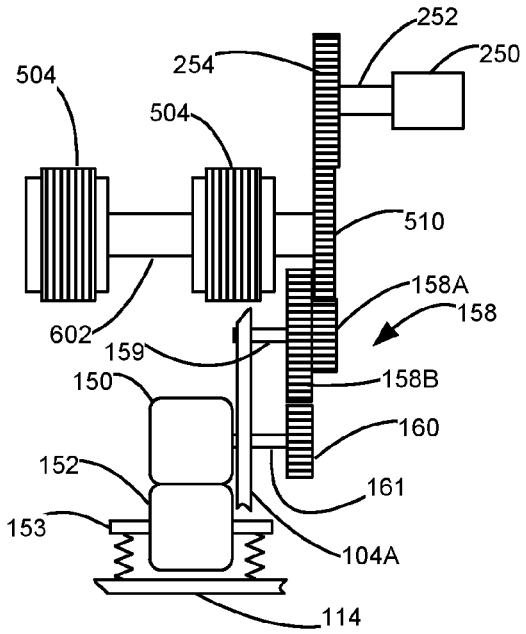
FIGS. 8A and 8B schematically illustrate two transmission arrangements for driving separator rolls mounted on the removable media dam.
Figure 8B:
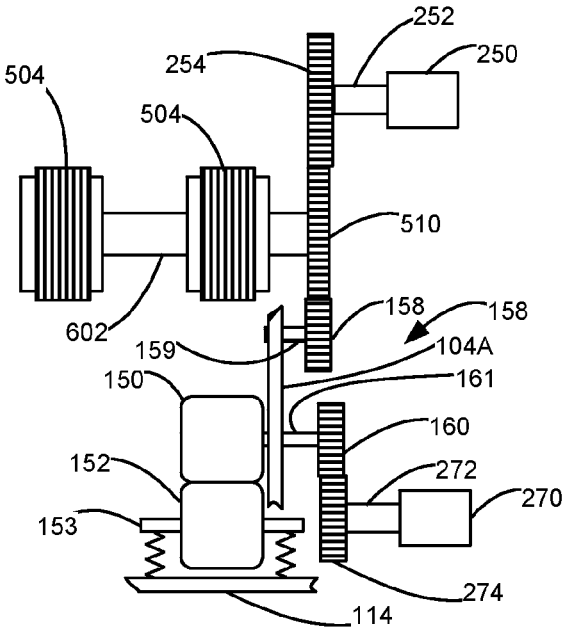

As may be more clearly understood with reference to FIG. 8A, feed motor 250 provided in housing 20 or housing 200 is operably coupled via coupler 252 to drive gear 254 which transmits torque to axle gear 510, pivot gear 158, and feed gear 160. Where channel 126 is not used, pivot gear 158 may be a non-compound gear affixed to shaft 162 and serves as an idler gear 158 about which axle gear 510 may rotate when being adjusted by separator roll positioner 550. Shown in FIG. 8B, feed motor 250 provided in housing 20 or housing 200 is operably coupled via coupler 252 to drive gear 254 which transmits torque to axle gear 510. Here pivot gear 158 is an idler gear and is not coupled to feed gear 160. Instead, an optional separate drive motor 270 may be used to drive feed gear 160 via a drive gear 274 mounted on the output shaft 272 of drive motor 270.

As previously described feed motor 250 drives gear 254 that is operably coupled to axle gear 510. Rotation of feed motor 250 in a first direction rotates axle gear 510 and in turn separator rolls 504 in a direction opposite to the media feed direction. This is done when media is being fed from media storage area 140. Rotation of feed motor 250 in a second direction opposite the first direction rotates axle gear 510 and pivot gear 158 and feed gear 160 in a direction to feed media in channel 126 in the media feed direction. This is done when media is being fed from a removable media input tray 100 in an inferior unit. Within a given removable media input tray, the feeding of media through channel 126 and from media storage area 140 does not occur currently.

Referring back to FIG. 7, removable media dam 500 is shown partially removed. Details of latch mechanism 512 according to one embodiment may be better seen. An opening in a side panel 520 of media dam 500 serves as latch catch 518. Actuator 514 has opposed side rails 521 slidably received into guide channels 522. A spring (not shown) is provided at a distal end of actuator 514 to bias actuator 514 toward side wall 104A and to bias latch hook 516 into latch catch 518. Stops (not shown) prevent actuator 514 from being pushed out of removable media input tray 100. To remove removable media dam 500, actuator 514 is depressed by a user. This allows latch hook 516 to release from latch catch 518, allowing a user to lift removable media dam 500 upwards and out of cavity 120 without the use of tools. Thus in this embodiment, removable media dam 500 is referred to as a tool-free removable media dam. A second side panel 522, opposite the first side panel 520 of the removable media dam 500 has at least one post 523 extending outwardly therefrom which is received in a corresponding opening in a wall of cavity 120. As shown, two posts 523 are illustrated (see FIG. 9). To insert the same or another removable media dam having different configuration of separator rolls 504 and/or a different media contact surface 502 or wear strips 508, a user would insert posts 523 into their corresponding openings in the wall forming cavity 120. Removable media dam 500 is then lowered into cavity 120 with latch hook 516 snapping into latch catch 518 completing installation of removable media dam 500. While latching assembly 512 is illustrated, one of skill in the art would recognize that other forms of mounts and snap fit mechanisms may be used to the same effect and that the illustrated latching assembly is not considered to be a limitation of the design. Removable media dam 500 may also be installed using conventional fasteners such as screws. In such an embodiment, latch assembly 512 would not be provided and removable media dam 500 would not be referred to as a tool-free removable media dam.

Figure 9:
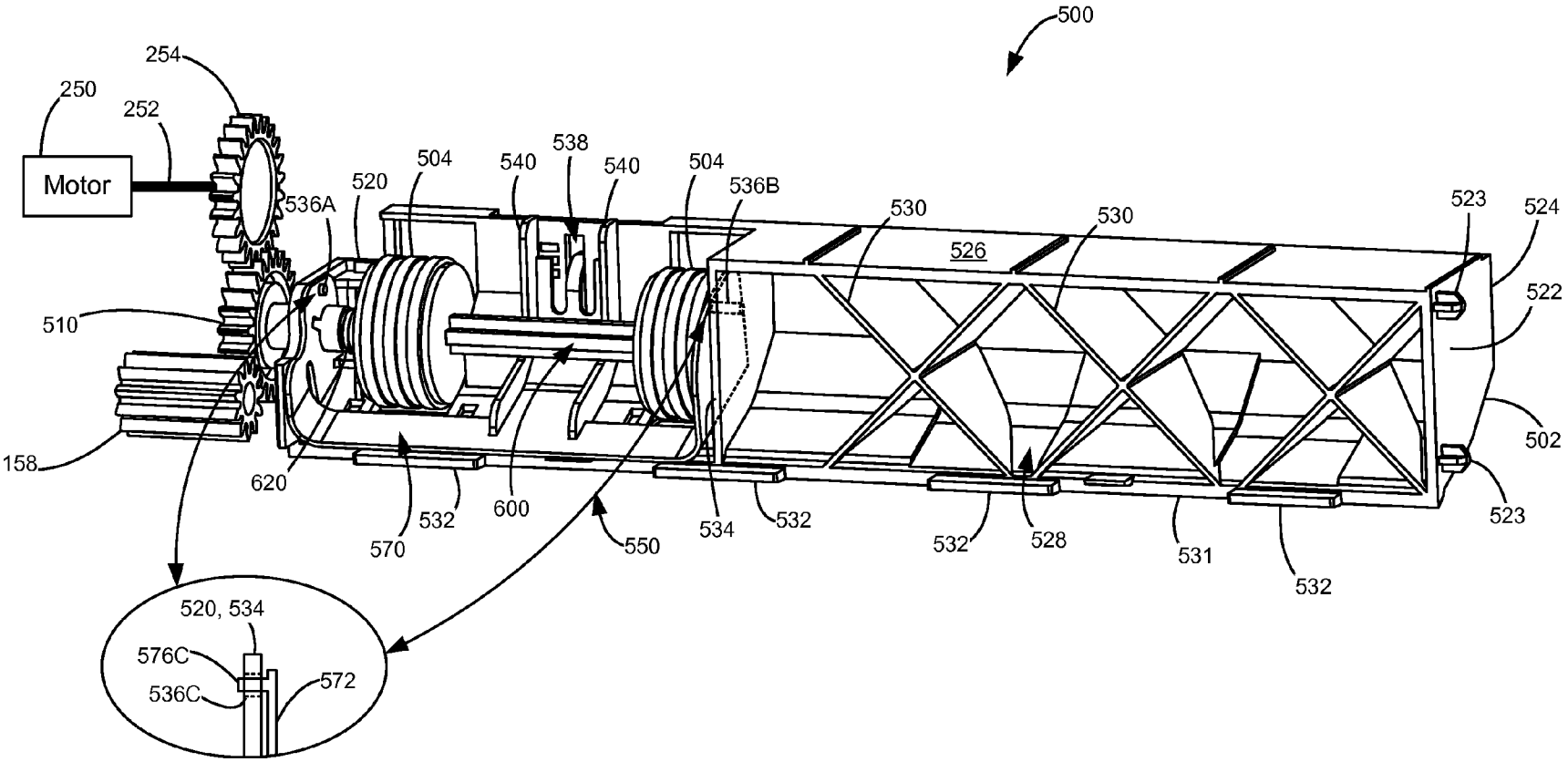
FIG. 9 is cutaway perspective view of the bottom of a removable media dam with a separator roll positioner and separator rolls.
Figure 10:
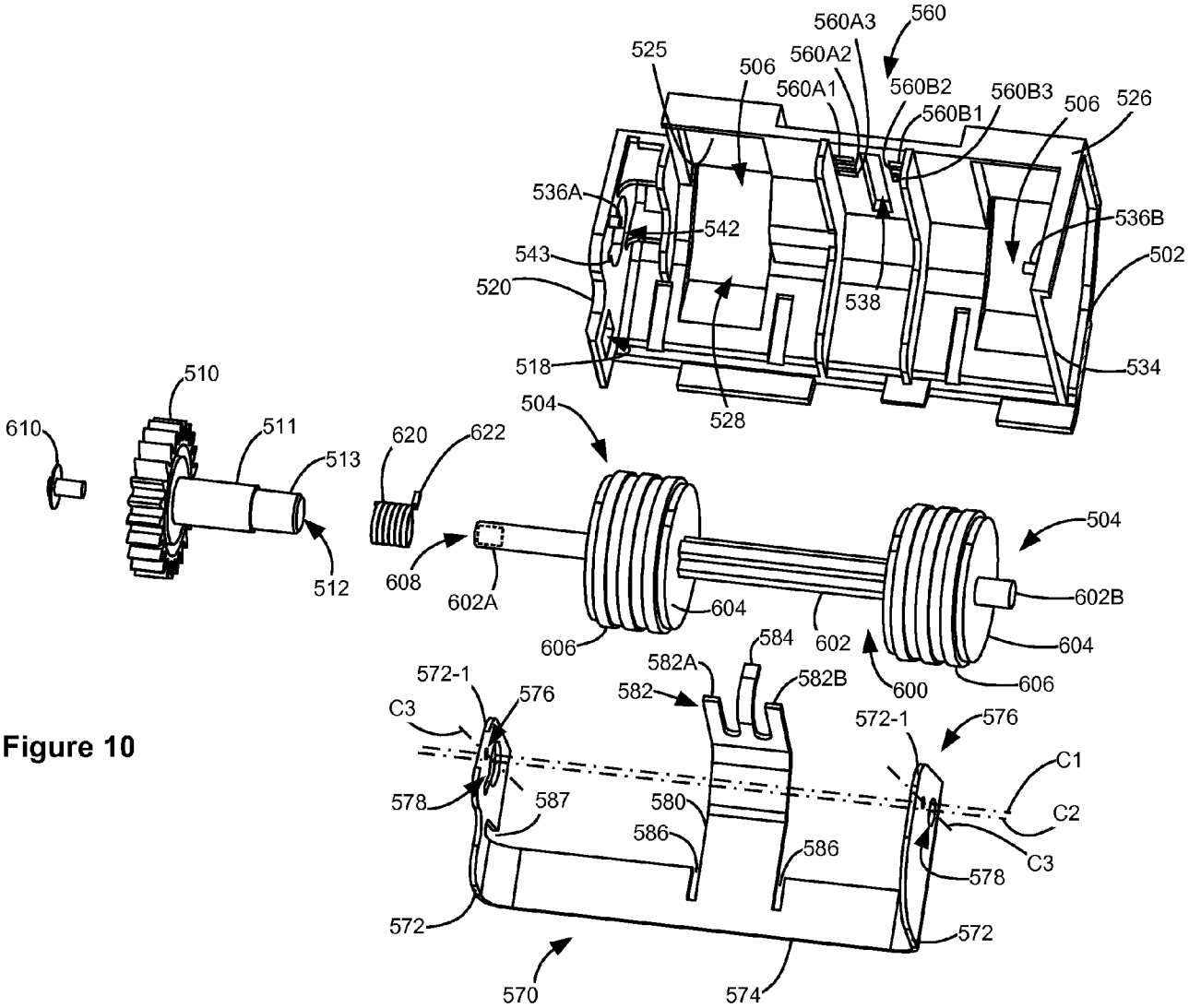
FIG. 10 is an exploded view of one example embodiment of the separator roll.

FIGS. 9-10 further illustrate one embodiment of separator roll positioner 550 in removable media dam 500. Within cavity 528, a support 534 is provided spaced apart from side panel 520. A pair of opposed mounts 536A, 536B are provided on side panel 520 and support 534 and define a pivot axis about which separator roll positioner 550 angular rotates. As illustrated the pair of mounts 536A, 536B are rods or pins extending out from side panel 520 and support 534 into cavity 528. Separator roll positioner 550 is pivotally mounted on the pair of mounts 536A, 536B as shown. A slot 538 is provided in top 524 between side panel 520 and support 534 through which a member of separator roll positioner projects. One or more stiffening ribs 540 may be provided on undersurface 525 of media dam 500 in the portion of cavity 528 where separator roll positioner 550 is mounted. Two L-shaped ribs 540 are shown. The shape and number of ribs 540 is a matter of design choice.

Separator roll positioner 550 comprises a U-shaped or C-shaped bracket 570 in which is rotatably mounted a wheel set 600. As illustrated, bracket 570 is comprised of a pair of opposed arms 572 depending toward rear surface 526 from a support member 574 as viewed in the figures. Depending upwardly from support member 574 and between the pair of arms 572 is lever 580 having a distal portion bent toward rear surface 525. Located on the free end of the distal portion are one or more catches 582 and tab 584. Lever 580 is bent so that tab 584 will be located on a portion of media dam 500 that is not in the media path or interfere with media contact surface 502. Lever 580 is used to angularly rotate bracket 570 about opposed mounts 536A, 536B. Tab 584 is illustrated as being between a pair of catches 582A, 582B. Other arrangements for tab 584 and catch 582 may be used.

Two pairs of aligned and opposed openings 576, 578, as indicated by centerlines C1 and C2, respectively, are provided in arm pair 572. Opening pair 576 in arm pair 572 is sized to rotatably receive mounts 536A, 536B, respectively. Shown in the inset in FIG. 9 is an alternative mounting arrangement for bracket 570. Side panel 520 and/or support 534 each has an opening 536C while each arm of arm pair 572 has a pin 576C received into respective openings 536C. Opening pair 578 rotatably supports wheel set 600 in bracket 570. One opening of the opening pair 578 may be sized as a matter of design choice to either to rotatably receive an end of axle 602 of the wheel set 600 and or, as illustrated in FIG. 10, a hub 511 of axle gear 510 while the other opening in opening pair 578 is sized to receive the other end of axle 602. When bracket 570 is installed on mounts 536A, 536B, free ends 572-1 of arm pair 572 would be adjacent to undersurface 525. The centers of opening pairs 576 and 578 are vertically aligned with one another as indicated centerlines C3 on each arm of arm pair 572.

When bracket 570 is attached to mounts 536A, 536B between side panel 520 and support 534 by inwardly flexing arms 572, tab 584 extends through slot 538 provided in the top 524 of media dam 500. A plurality of detents 560 may be provided on the undersurface 525 of top 524 and are sized to receive catches 582. As shown, detents 560A1-560A3 are provided along a side of slot 538 and are engageable with catch 582A while detents 560B1-560B3 are correspondingly positioned along the opposite side of slot 538 and are engageable with catch 582B. While two catches and two sets of detents are shown, a single catch and a single set of detents may also be used. Lever 580 is resilient and flexes to allow catches 582A, 582B to be disengaged from detents 560A1-560A3, 560B1-560B3 and slide between them when tab 584 is grasped and moved by a user to adjust the position of separator rolls 504. Detents 560 are spaced to provided a plurality of predetermined positions for separator rolls 504. Three positions are shown. As a user moves tab 584 along slot 538, bracket 570 pivots or angularly rotates about mounts 536A, 536B in turn angularly rotating wheel set 600 and ultimately the position of separator rolls 504 with respect to media contact surface 502 and or wear strips 508.

Slots 586 may be provided in support member 574 adjacent to the attachment location of lever 580 to increase the degree of flexibility of lever 580 and/or to accommodate ribs 540 when bracket 570 is installed within cavity 528. A slot may be provided in one arm of the pair of arms 572 to allow that arm to be twisted and flexed during installation. As shown the arm of arm pair 572 adjacent side panel 520 has a slot 587 for this purpose.

Figure 16:
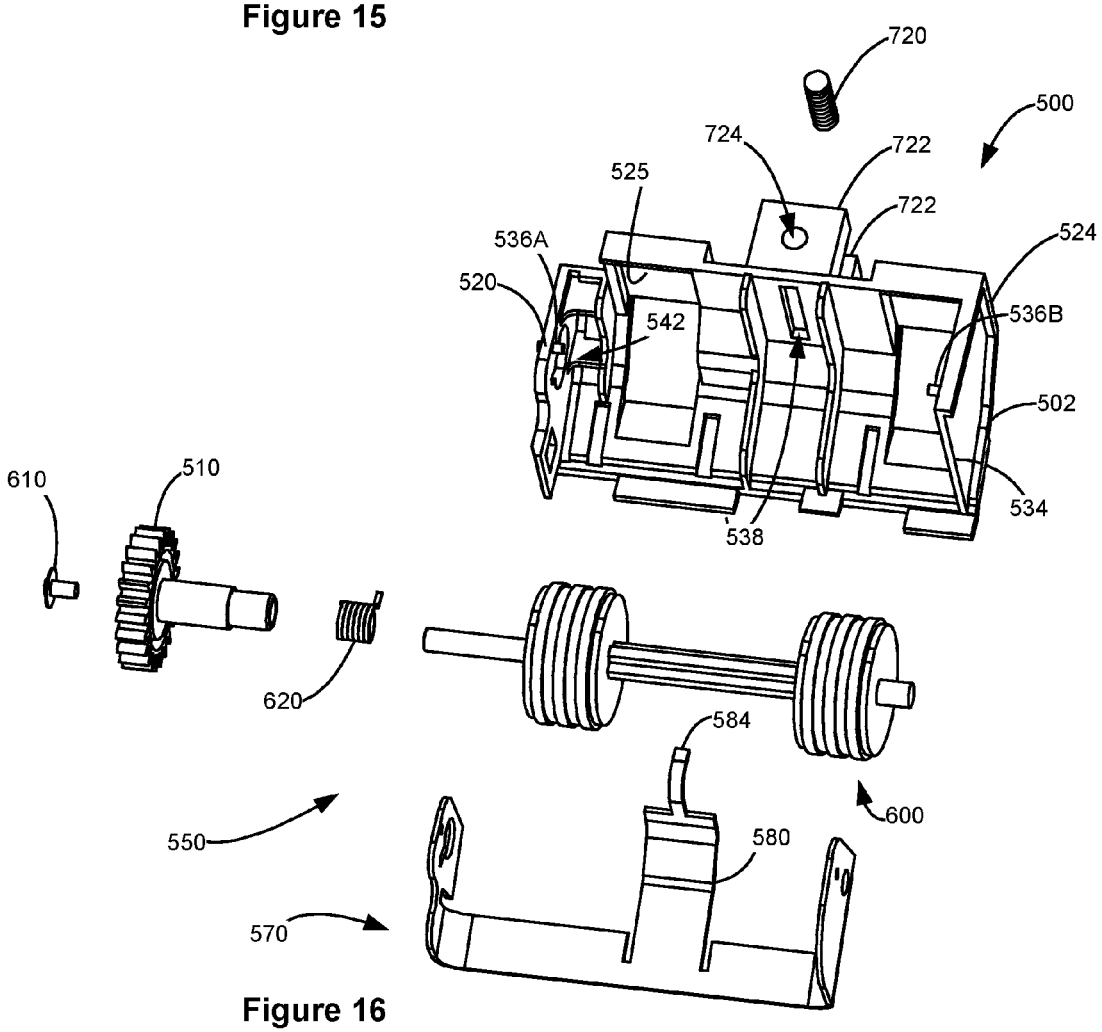
FIG. 16 is an exploded view of the separator roll positioner of FIG. 15.

Wheel set 600 comprises an axle 602 on which are mounted one or more separator rolls 504. Two separators rolls 504 are shown and are spaced apart to be received through respective openings 506 in removable media dam 500. Separator rolls 504 are illustrated as including a hub 604 that is mounted on axle 602 and a tire 606 mounted about the circumference of hub 604. Tires 606 may have various tread patterns, like those on a tire, on their surfaces which contact the media being fed from removable media input tray 100. Tires 604 may have tread patterns that are the same or different. The tread patterns used are a matter of design choice. Ends 602A, 602B of axle 602 are rotatably received in respective openings in opening pair 578, which provide a bearing surface for the ends 602A, 602B of axle 602. End 602A is elongated to also extend through opening 542 in side panel 520 and is operably connected to hub 511 of axle gear 510. In one form, axle 602 and axel gear 510 are coaxial but need not be so arranged as shown in FIG. 16. End 602A may be provided with an opening 608 and a fastener, such as screw 610, is inserted through axle gear 510 and into hole 608 when axel gear 510 is attached to axle 602. As shown hub 511 has an opening 512 sized to rotatably receive axle end 602A. Normal friction between the surface of axle end 602A and the surface of opening 512 allows axle gear 510 and shaft 602 to rotate together. Opening 542 in side panel 520 is sized to allow axle 602 to angularly rotate as bracket 570 is moved so that separator rolls 504 can be adjustably positioned in openings 506 of media dam 500 as described infra. Opening 542 may be arcuate or straight. Axle 602 and hubs 604 of wheel set 600 may be molded as a unitary piece or may be separate pieces that are assembled together. Other configurations for separator rolls 504 may be used. For example, one separator roll or three or more separator rolls may be mounted on axle 602 along with a corresponding number of openings 506 being provided in media contact surface 502.

In one example embodiment, a clutch 620, such as spring clutch 620, may be mounted between hub 511 of drive gear 510 and end 602A of axle 602. As shown, a neck portion 513 is provided on hub 511 to accommodate the mounting of clutch 620, such as spring clutch 620. A tang 622 on clutch 620 engages with a corresponding opening or slot in hub 604 of the separator roll that is adjacent to end 602A. A notch 543 in opening 542 may be provided to accommodate the insertion of tang 622 into hub 604. Clutch 620 is used to ensure that separator rolls 504 will only rotate in one direction that is opposite to the media feed direction and will allow axle 602 to slip when separator rolls 504 are either stopped due to a jam or their rotation is reversed. As viewed in FIGS. 9-10, separators rolls 504 would turn in a clockwise direction. Clutch 620 may be used where pivot gear 158 also drives feed roll 150. This would avoid the feeding of any media within media storage area 140 of removable media input tray 100 that may be in contact with separator rolls 504 due to being shingled from a prior media feed.

Figure 11A:
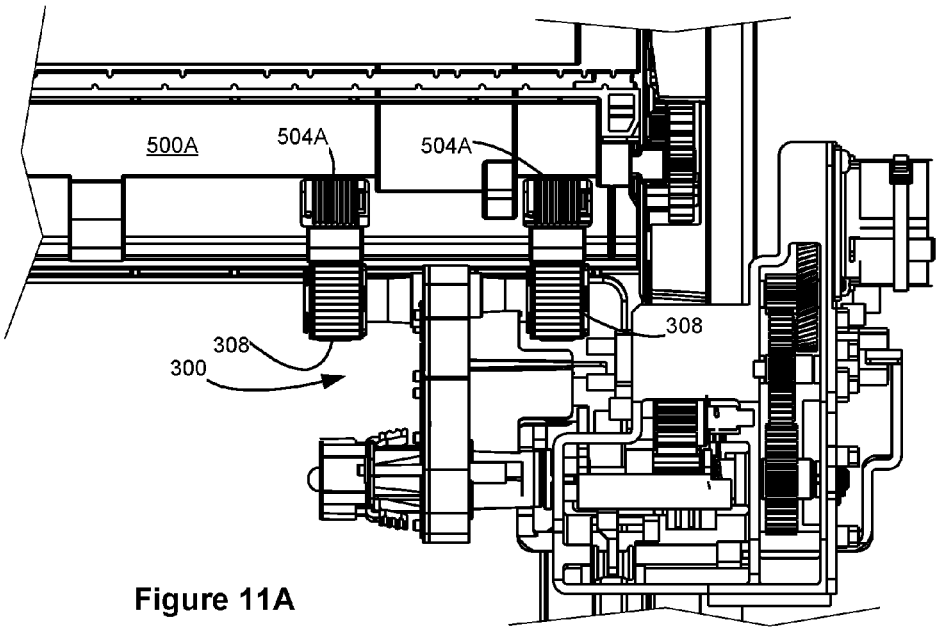
FIGS. 11A and 11B are an alternate arrangement of separator rolls in a removable media dam.
Figure 11B:
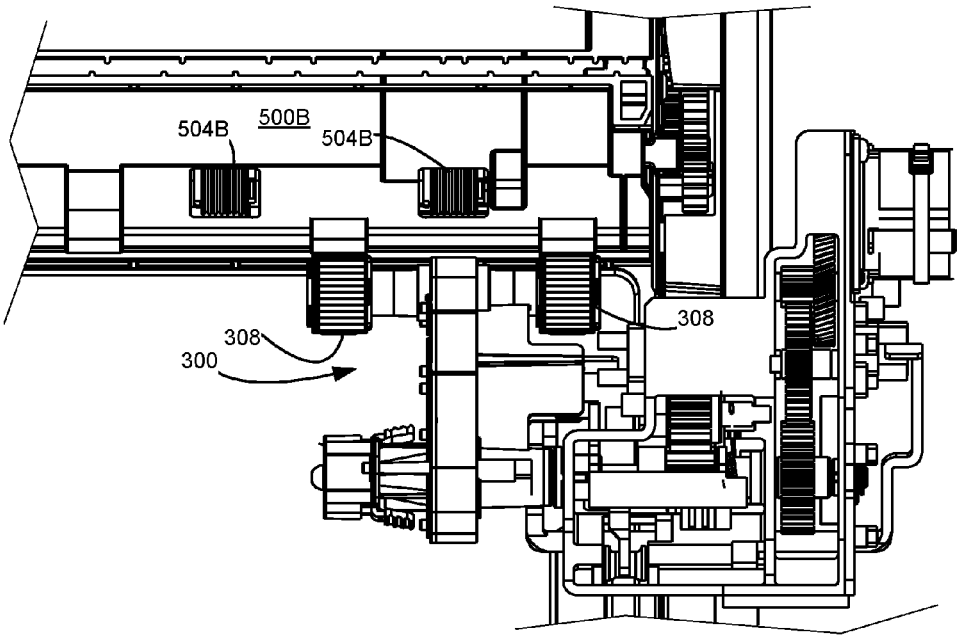

Removable media dam 500 allows a user to replace a removable media dam having worn separator rolls 504 with a new removable media dam having new separator rolls, or to use separator rolls having a different tread, or a media dam having a different number or different configuration of separator rolls without the need to have different removable media input trays, or a different number configuration of wear strips or patterns used on the wear strips. FIGS. 11A and 11B show two embodiments of a removable media dam having different configurations for separator rolls 504. FIG. 11A shows for media dam 500A, a separator roll 504A aligned with each the pick wheel 308 of pick mechanism 300. FIG. 11B shows for media dam 500B, the separator rolls 504B being transversely or laterally offset from pick tires 308 of pick mechanism 300.

In some embodiments, separator rolls 504 are rotated counter to the media process direction throughout the duration of each pick cycle. Separator rolls 504 in some embodiments rotate at a slower speed than that of the pick wheels 308, such as between 40-60 percent of the rotational speed of the pick wheels 308. The counter rotation of the separator rolls 504 helps to prevent shingling and misfeeds of media. During shingling, a second or following sheet is also fed from the top of the media stack but its leading edge is slightly behind or shingled with respect to a topmost sheet being fed. As both media approach the separator rolls 504, the leading edge of topmost sheet strikes the surface of the separator roll tangentially and continues across the surface. If the topmost sheet is skewed when it reaches the separator rolls 504, then one side of its leading edge will reach the separator rolls 504 before the other thereby encountering a drag force that will correct the skew. The leading edge of the shingled media strikes the surface of the separator rolls 504 in a normal direction and is stopped by separator rolls 504 while the topmost media continues being fed. The separator rolls 504 return the second media sheet to a separation point upstream and adjacent the separator rolls 504. Separator rolls 504 and pick wheels 308 form what is termed an "open nip" in that, as shown, the separator roll 504 is downstream and spaced away from pick wheels 308. The use of an open nip allows pick mechanism 300 to be placed in a variety of positions such as being center referenced or being edge referenced as illustrated. An advantage of using an open nip design lies in its ability to deskew media as just described.

Figure 12:
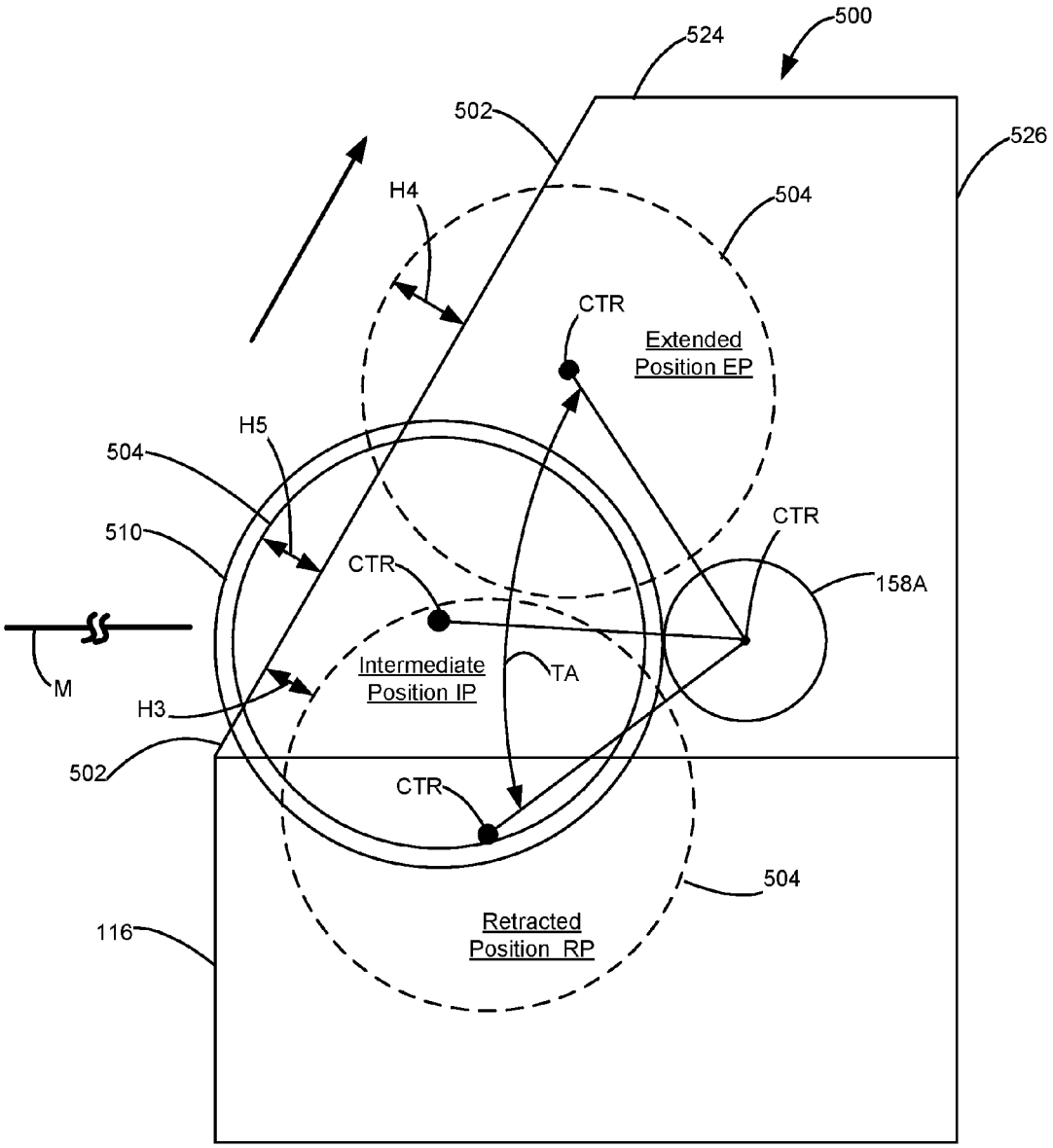
FIG. 12 is a schematic illustration of the range of adjustment of the separator rolls in a media dam.

As separator roll positioner 550 is adjusted by moving tab 584 along slot 538, axle gear 510 rotates around pivot gear 158A as shown allowing separator rolls 504 to angularly rotate into or out of media contact surface 502. This is illustrated in FIG. 12. Schematically illustrated are removable media dam 500 mounted atop rear portion 116 of front wall 102 along with separator roll 504, axle gear 510 and pivot gear 158A. A media sheet M is shown positioned adjacent the bottom edge of media contact surface 502. It is understood the media sheet M would be supported by lift plate 172 and, during feeding, driven by pick mechanism 300 into and along media contact surface 502 along the media process direction indicated by the arrow. Separator roll 504 is shown in three positions—a retracted position RP, an intermediate position IP, and an extended position EP, which, in one embodiment, correspond to detents 560A1-560A3. The intermediate position may also be termed the standard position as that is the position at which the separator roll 504 is typically set when media dam 500 is initially installed. One or more intermediate positions may be provided. Separator roll 504 is shown in dashed lines in the retracted and extended positions RP, EP. The centers CTR of axle gear 510 and separator rolls 504 are coincident. As axle gear 510 rotates about the circumference of pivot gear 158A between retracted position RP and extended position EP, separator roll 504 travels though arc TA and the height of the surface of separator roll 504 with respect to the media contact surface 502 and/or wear strips 508 goes from being a negative height value H3 to a maximum positive height value H4, the height convention being positive when the surface of separator roll 504 is above the surface of media contact surface 502 and/or wear strips 508 and negative when below. At the intermediate position IP, the separator roll is at height H5 that is less than height H4 and greater than height H3. In one embodiment these three positions are predetermined such as by the use of detents, such as detents 560, positioned along slot 538. In other embodiments, travel arc TA is about 24 degrees, but this should not be considered as a limitation of the design as lesser and greater travel arcs may be used. In a further embodiment, the intermediate position IP is set to be in the middle of travel arc TA so that separator roll 504 moves either about 12 degrees clockwise to reach extended position EP and about 12 degrees counter-clockwise to reach retracted position RP as viewed in FIG. 12. In one embodiment, the heights H3, H5 and H4 are about −0.35 mm, about 2.1 mm and about 3.18 mm, respectively. Other travel arc values and height values may be used and are dependent on the diameter of separator roll 504 and the height of opening 506 in media dam 500.

Should lightweight paper media be present in removable media input tray 100, a user may select the retracted position RP for separator roll 504 because the contact of such media against media contact surface 502 and/or wear strips 508 provides sufficient separation force acting on the following media sheet. Should standard weight paper media be present in removable media input tray 100, a user may select the intermediate position IP for separator roll 504 as the higher separation forces provided by separator roll at height H5 are sufficient. Should heavyweight paper media be present in removable media input tray 100, a user may select the extended position EP for separator roll 504 because a greater amount of separation force is needed to separate the sheets of media being fed.

In general, for a given type of media, the heavier the weight of the media the higher the separation force required. However, this general statement may not always hold true due to factors within a given media type such as media surface characteristics and media construction. Given in Table 1 are example separator roll positions that have being empirically determined. The first column provides the separator roll position. The second column provides a media weight range in grams per meter squared while the last column provides representative media types.

TABLE 1

| Separator Roll Position | Media Weight ($gm/m^2$) | Media Type |
|---|---|---|
| EP | >275 | Vinyl |
| EP | 176-203 | Cardstock |
| EP | 160-180 | Label |
| EP | 176-220 | Polyester |
| IP | 105-176 | Paper |
| IP | 135-176 | Cardstock |
| IP | 176-220 | Polyester |
| IP | 60-75 | Paper, Cardstock, Paper Labels, Pharmacy Labels |
| IP | 260-275 | Vinyl |
| RP | <60 | Paper |
| RP | 60-130 | Label |

As can be seen in Table 1 when vinyl media is present in removable media input tray 100 either the intermediate or extended positions, IP, EP may be used. In such situations, the lower position, intermediate position IP, is initially used for separator roll 504. Should media feeding problems arise, the higher position, extended position EP, would then be used as an alternate position for separator roll 504. When label media is present in removable media input tray 100, the retracted or extended positions, RP, EP may be used. Again, the lower position, retracted position RP, is initially used for separator roll 504 and should media feeding problems arise, the higher position, extended position EP, would then be used as an alternate position for separator roll 504. These media types and corresponding initial and/or alternative positions may be stored in memory 8 for use by controller 3 when adjusting the position of separator rolls 504.

Figure 13:
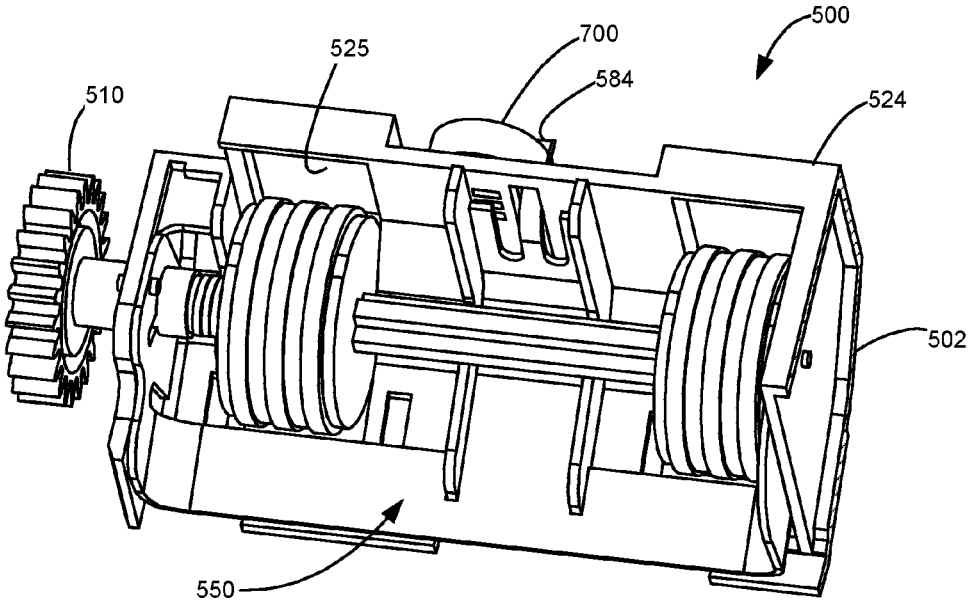
FIG. 13 is an illustration of an example embodiment of a separator roll positioner having a dial-type adjustment.
Figure 14:
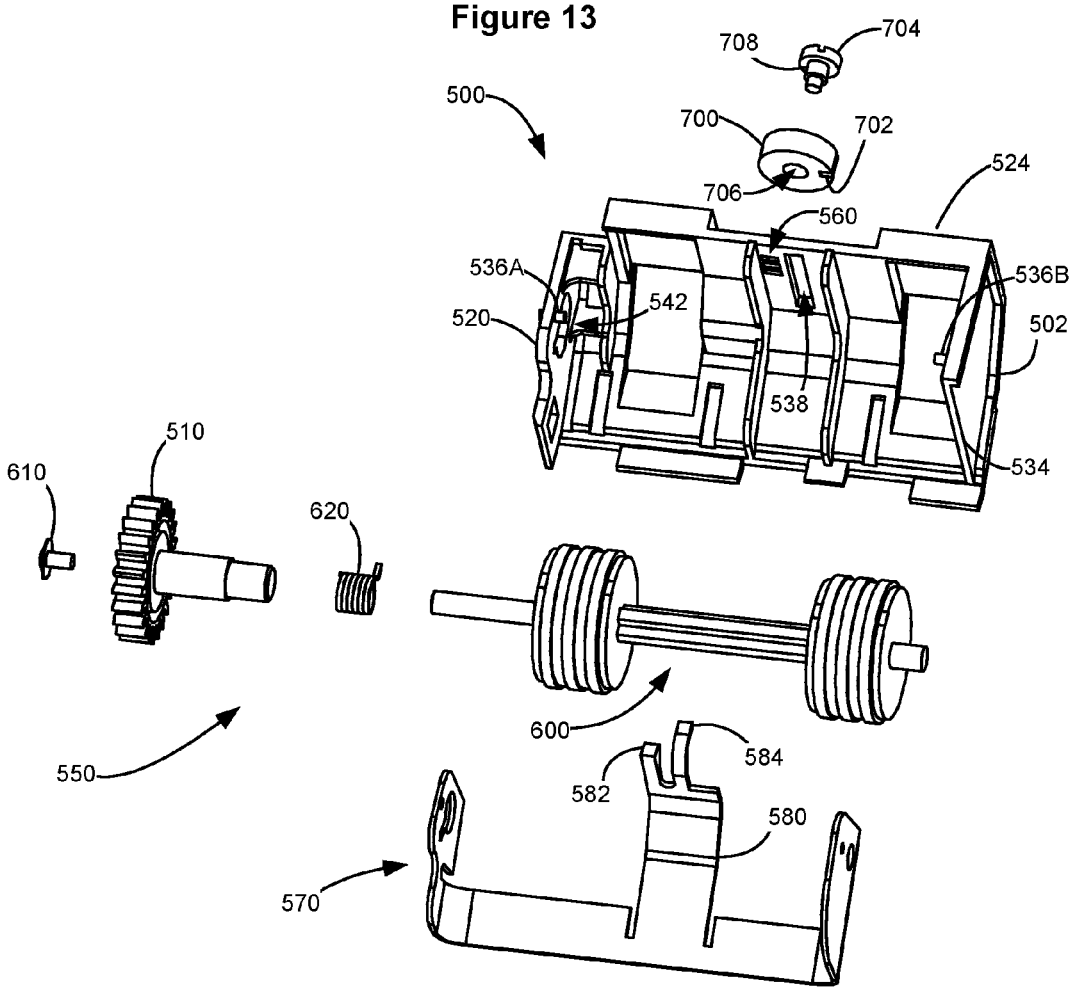
FIG. 14 is an exploded view of the separator roll positioner of FIG. 13.

In FIGS. 13-16 further embodiments of separator roll positioner 550 are shown utilizing various drive mechanisms to move tab 584 along slot 538 to angularly rotate wheel set 600. Referring now to FIGS. 13 and 14, another example embodiment of separator roll positioner 550 is shown. This embodiment is substantially the same as that described in FIGS. 9-10 and as such will carry the same reference numerals for components that are the same in both embodiments. Separator roll positioner 550 is adjusted by use of a dial 700 rotatably mounted on top surface 524 of media dam 500. A slot 702 is provided in dial 700 and is sized to receive the portion of tab 584 that projects above top 524. Dial 700 is secured to top 524 by a fastener 704, such as screw 704, passing through opening 706 in dial 700 that is secured to top 524. Screw 704 is also shown having an unthreaded portion 708 about which dial 700 may rotate. Member 580 is resilient and flexes to allow catches 582 to be disengaged from detents 560 when tab 584 is moved along slot 538 as dial 700 is rotated by a user to adjust the position of separator rolls 504. Detents 560 are spaced to provide a plurality of predetermined positions for separator rolls 504. As a user rotates dial 700, tab 584 moves along slot 538, bracket 570 pivots or angularly rotates about mounts 536A, 536B in turn rotating wheel set 600 and ultimately the position of separator rolls 504 with respect to media contact surface 502 and/or wear strips 508.

Figure 15:
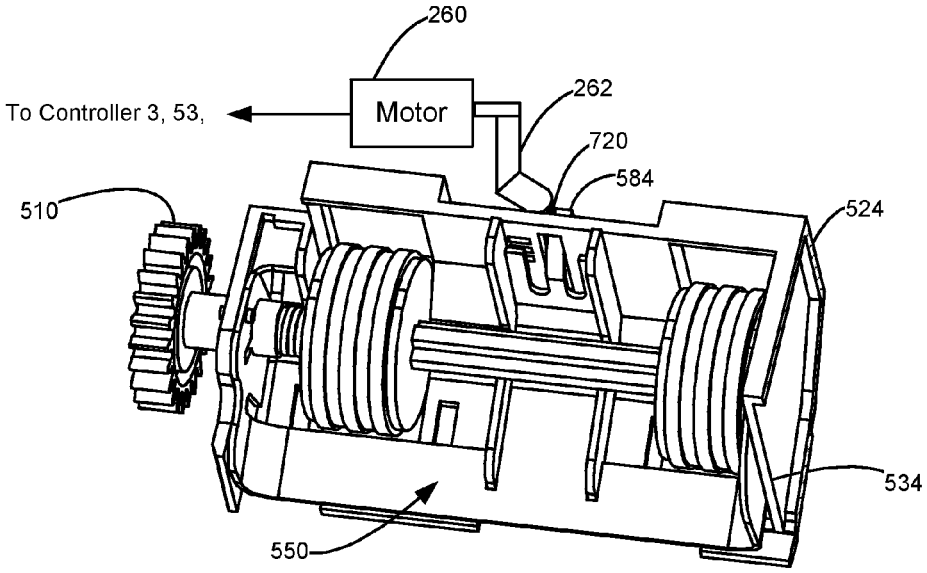
FIG. 15 is an illustration of an example embodiment of a motor operated separator roll positioner.

Referring now to FIGS. 15 and 16, another example embodiment of separator roll positioner 550 is shown. This embodiment is substantially the same as that described in FIGS. 9-10 and as such will carry the same reference numerals for components that are the same in both embodiments. Separator roll positioner 550 is adjusted by use of a positioner motor 260 driving a worm gear 720 that is rotatably mounted on top surface 524 of media dam 500. Positioner motor 260 is operably connected to worm gear 720 via transmission 262. Bearing supports 722 having openings 724 therein for rotatably receiving respective ends of worm gear 720 may be fastened to or molded into top 524 to rotatably support respective ends of worm gear 720 that is aligned with slot 538. The portion of tab 584 of lever 580 that projects above top 524 is operably coupled to worm gear 720 and rides within the flight of worm gear 720. Supports 722 have been removed from FIG. 14 to better illustrate the coupling between worm gear 720 and tab 584. When worm gear 720 is rotated in first direction by positioner motor 260, tab 584 is driven along slot 538 toward an end thereof to adjust the position of separator rolls 504 in positioner 550. When positioner motor 260 is rotated in a direction opposite to the first direction, tab 584 is driven along slot 538 toward the other end of slot 538 adjusting the position of separator rolls 504 in a second opposite direction. When positioner motor 260 stops, separator roll positioner 550 is held in position by worm gear 720. Although catch 582 and detents 560 may still be present, they would be redundant and, in this embodiment, become optional and for this reason are not shown in the FIG. 16. With this arrangement, the angular position of separator rolls 504 is continually variable between the retracted and extended positions RP, EP. Media type sensor 15 may provide an input signal to controller 3 indicative of the type of media within the media storage area 140 of removable media tray 100. Controller 3 may then use this information to determine the optimal position for separator rolls 504 based on the detected media type. In one mode controller 3 may drive worm gear 720 a predetermined time period in a predetermined direction to ensure that tab 584 is in a known position and then driving worm gear in the opposite position for another predetermined time period needed to move tab 584 and ultimately separator rolls 504 to the desired position. In another mode, worm gear 720 is initially set at a predetermined location, such as retracted position RP, intermediate position IP or extended position EP, and the number and direction of revolutions of motor 260 or worm gear 720 is then counted to move separator rolls 504 to another predetermined location based on the media type.

Figure 17:
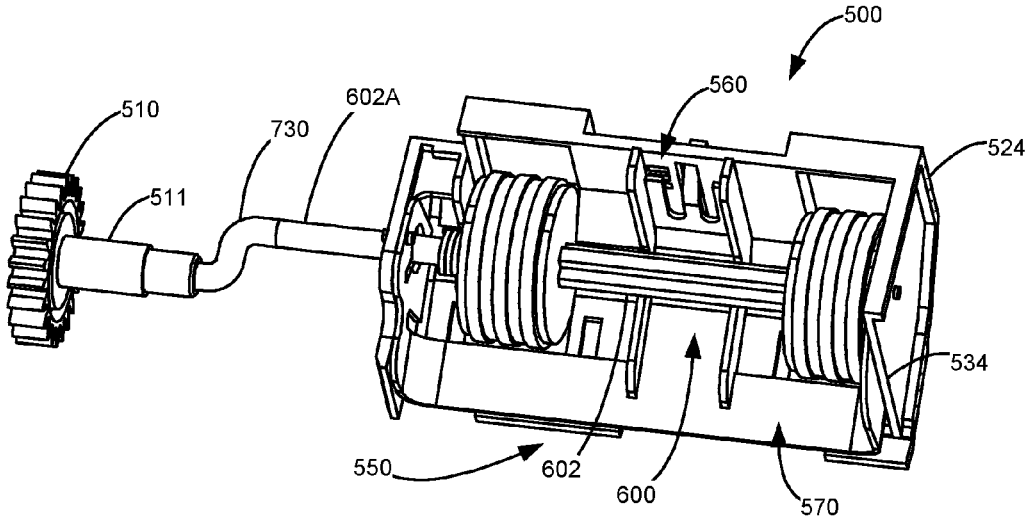
FIG. 17 is an illustration of a separator roll positioner utilizing a flexible drive coupling.

Referring now to FIG. 17, another example embodiment of separator roll positioner 550 is shown. This embodiment is substantially the same as that described in FIGS. 9-10 and as such will carry the same reference numerals for components that are the same in both embodiments. In the embodiment shown in FIG. 17 a flexible coupling 730 has been inserted between end 602A of axle 602 and hub 511 of axle gear 510. The addition of flexible coupling 730 allows pivot gear 158 to be eliminated while allowing axle gear 510 to remain operably coupled to drive gear 254 as wheel set 600 is angularly rotated by separator roll positioner 550. The flexible coupling 730 may be tubing, a coil spring, an Oldham coupler, or another flexible coupler as is known in the art, and allows the offset axle 602 to be rotated by drive gear 510. It should be realized that the amount of offset between axle 602 and hub 511 would be in the range of +/−3 mm.

Figure 18:
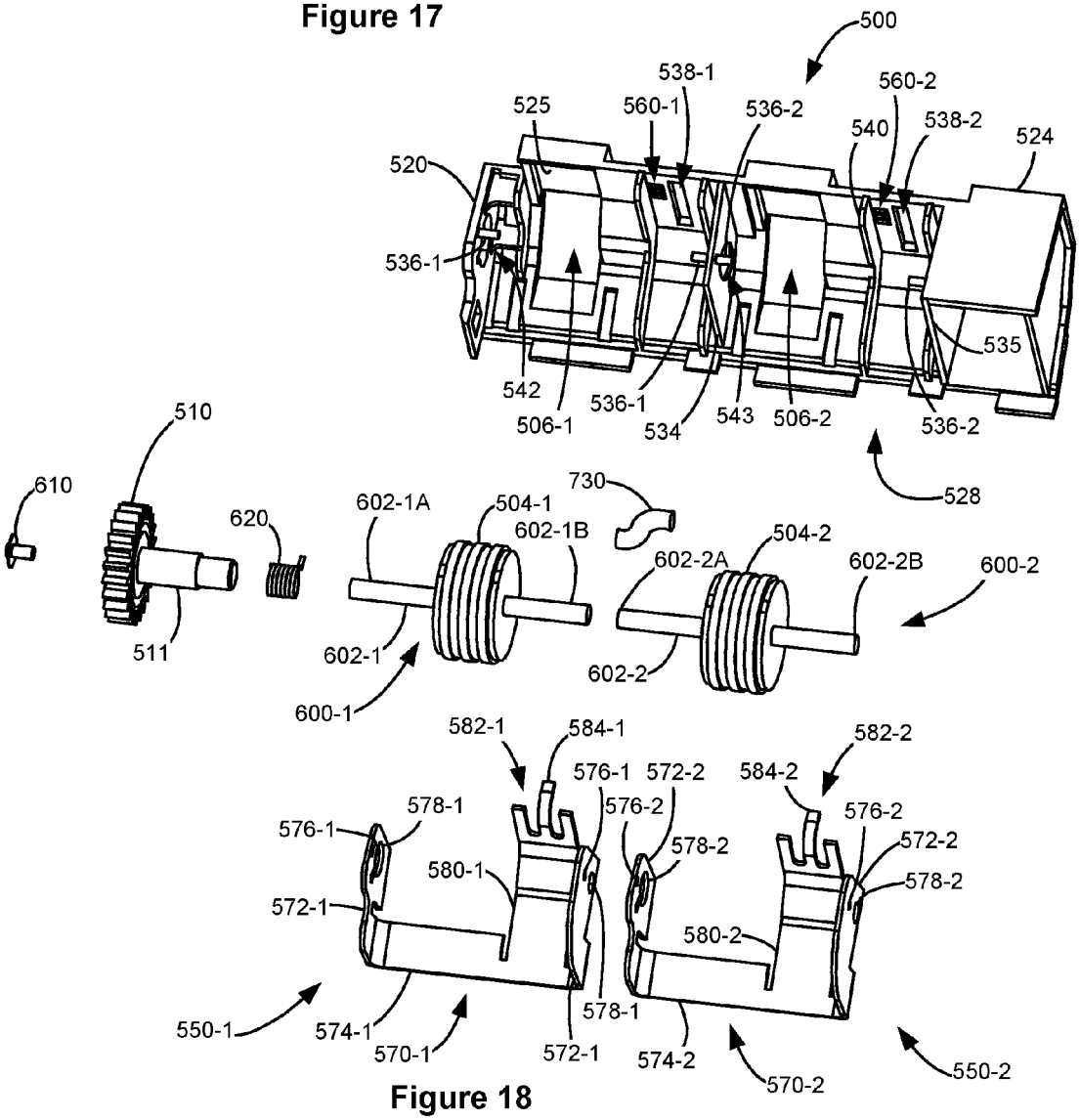
FIG. 18 is an exploded view of a separator roll positioner having individually positionable separator rolls.

Another embodiment of a separator roll positioner is illustrated in FIG. 18. Where possible the same or similar elements will have reference numerals that are the same or similar to those provided in FIGS. 9-10. In FIG. 18 two separator roll positioners 550-1, 550-2 are provided, each with a bracket 570-1 570-2 in which is mounted a wheelset 600-1, 600-2 each having a single separator roll 504-1, 504-2, respectively. Within cavity 528, a second support 535 is provided, going from to side panel 520, inboard of support 534. A pair of opposed mounts 536-1, 536-1 provided on side panel 520 and support 534 and another pair of opposed mounts 536-2, 536-2 is provided on supports 534 and 535 for rotatably supporting brackets 570-1, 570-2, respectively. Openings 506-1, 506-2 in media contact surface 502 are provided between side panel 520 and support 534 and between support 534 and second support 535, respectively. Slots 538-1, 538-2, similarly positioned to openings 506-1, 506-2, are provided in top panel 524 for tabs 584-1 and 584-2, respectively. Again, one or more stiffening ribs 540 may be provided on undersurface 525 of media dam 500.

Separator roll positioners 550-1, 550-2 comprise U-shaped brackets 570-1, 570-2 in which is rotatably mounted a wheel set 600-1, 600-2. Brackets 570-1, 570-2 are constructed substantially the same as bracket 570 previously described. As illustrated, bracket 570-1 is comprised of a pair of opposed arms 572-1, support member 574-1, lever 580-1, catches 582-1, tab 584-1 and two pairs of aligned openings 576-1, 578-1 in arms 572-1. Similarly, bracket 570-2 is comprised of a pair of opposed arms 572-2, support member 574-2, actuator member 580-2, catches 582-2, tab 584-2 and two pairs of aligned openings 576-2, 578-2 in arms 572-2. Mounts 536-1 are received in respective openings 576-1 and mounts 536-2 are received in respective openings 576-2. Again, the alternate mounting arrangement shown in the inset of FIG. 9 may be used with brackets 570-1, 570-2. Positioning for openings 576-1, 576-2, 578-1, 578-2 is as previously described. Detents 560-1, 560-2 may be provided adjacent slots 538-1, 538-2, on the undersurface 525 of top 524 to engage with catches 582-1, 582-2, respectively, to individually set each of separator roll positioners 550-1, 550-2 to a selected one of a plurality of predetermined positions as determined by detents 560-1, 560-2.

Wheel sets 600-1, 600-2 may be constructed as previously described and comprise an axle 602-1, 602-2 on which are mounted one or more separator rolls 504-1, 504-2. Separator rolls 504-1, 504-2 are similar constructed to separator roll 504 previously described. Ends 602-1A, 602-1B of axle 602-1 are rotatably received in respective openings in pair of openings 578-1. End 602-1A is elongated to also extend through opening 542 in side panel 520 and is operably connected to hub 511 of axle gear 510. Axle 602-1 and axle gear 510 are shown as coaxial; however, a flexible coupling may be used as shown in FIG. 17. End 602-1A may be provided with an opening and a fastener 610, such as screw 610, may be used to attach axle gear 510 to axle 602-1. An opening 543 is provided in support 534 so that end 602-1B of axle 602-1 can be coupled to end 602-2A of axle 602-2 via a flexible coupling 730 as previously described. Openings 542, 543 are sized to allow axles 602-1, 602-2 to angularly rotate as brackets 570-1, 570-2 are moved so that each separator roll 504-1, 504-2 can be individually adjusted, in the manner previously described, in their respective openings 506-1, 506-2 of media dam 500.

Dual separator roll positioners 550-1, 550-2 allow the position of separator roll 504-1 to be independently adjusted from that of separator roll 504-2 and provides for skew adjustment of the media. Also the number of separator rolls provided in each wheel set 600-1, 600-2 may be the same, or different. Where additional separator rolls are provided corresponding openings are provided in media contact surface 502. With this embodiment, dials or worm gears may also be used, two dials or two worm gears or one dial and one worm gear would be used one attached to tabs 584-1, 584-2. In the latter configuration the separator rolls operably coupled to the dial would be manually set while the separator roll connected to the worm gear would be set by controller 3 using a positioner motor, such as positioner motor 260. For the two worm gear configuration, controller 3 would set the position of each of separator rolls 504-1, 504-2 independently using two positioner motors, one for each worm gear. Again the position at which each of separator rolls 504-1, 504-2 is set by controller 3 may be based on the type of media sensed by media type sensor 15.

With the various illustrated example embodiments of the separator roll positioner, it should be realized that the angular position of the wheelset 600 may be set manually to an initial position when the removable media dam 500 is not mounted in the removable media tray 100. However, it is advantageous that once the removable media dam 500 is installed, the angular position of the wheelset 600 can be adjusted without having to dismount the removal media dam from the removable media tray 100. This permits separator roll positioner 550 to be built into a nonremovable media dam.

Figure 19:
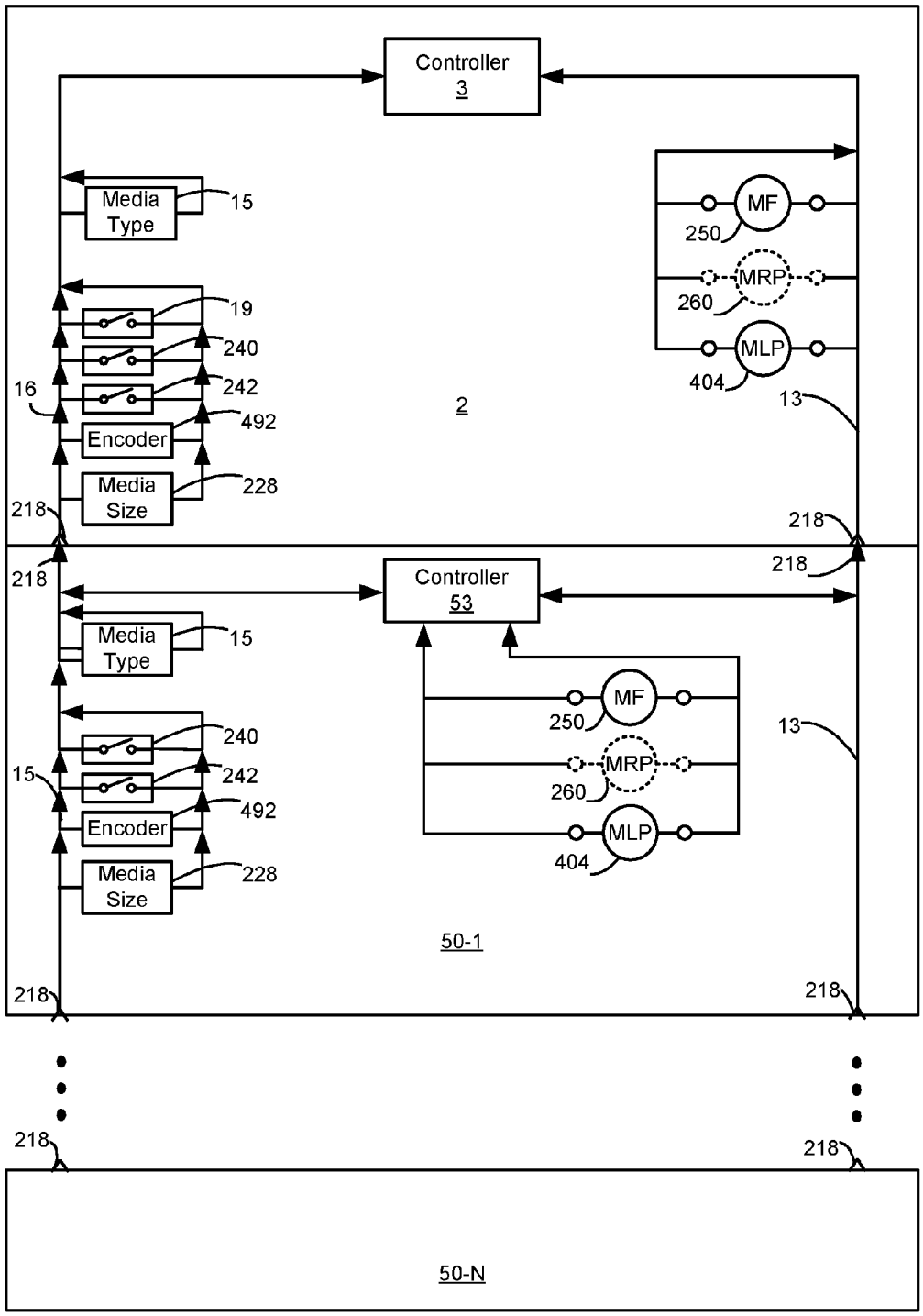
FIG. 19 is an electrical schematic of the sensors and motors used in one embodiment of image forming apparatus and option assemblies.

A basic schematic of the various sensors and motors used to feed media to image forming device 2 is illustrated in FIG. 19. Image forming apparatus 2 and with controller 3 is shown on top of two option assemblies 50-1 through 50-N. Communication links 13 and 16 from controller 3 are connected to each option assembly 50-1 through 50-N via electrical connectors 218 as previously described. Media sensors 15 and 19 located in image forming device 2 are shown connected to communications link 16, which is shown providing input signals to controller 3 while communication link 13 is shown providing output signals from controller 3. Communication links 13 and 16 may be one communication link. Also provided in image forming apparatus 2 are media sensor 240 for sensing media in channel 126, media sensor 242 for sensing media picked from removable media input tray 100, encoder wheel sensor 492 and media size sensor 228. Connected to communication link 13 are feed motor 250 that drives feed roll 150 and separator roll 504, an optional roll positioner motor 260 used to adjust the separator roll position within media dam 500, and drive motor 404 used for the drive mechanism 400 that powers pick mechanism 300 and drives the lift arm 173 to raise lift plate 172 for indexing the media into the picking location.

In option assembly 50, connected to communication link 16, are media type sensor 15, media sensor 240 for sensing media in channel 126, media sensor 242 for sensing media picked from removable media input tray 100, encoder wheel sensor 492, media size sensor 228 and controller 53, all of which provide data used by controller 3. Connected to communication link 13 is controller 53 which receives communications from controller 3 for feeding media out of removable media input tray 100 and along media path extensions PX. Feed motor 250 that drives feed roll 150 and separator roll 504 and drive motor 404 used for the drive mechanism 400 that powers pick mechanism 300 and drives the lift arm 173, are controlled by controller 53. Also shown in operable communication with controller 53 is optional motor 260 for positioning separator rolls 504 within media dam 500.

Figure 20:
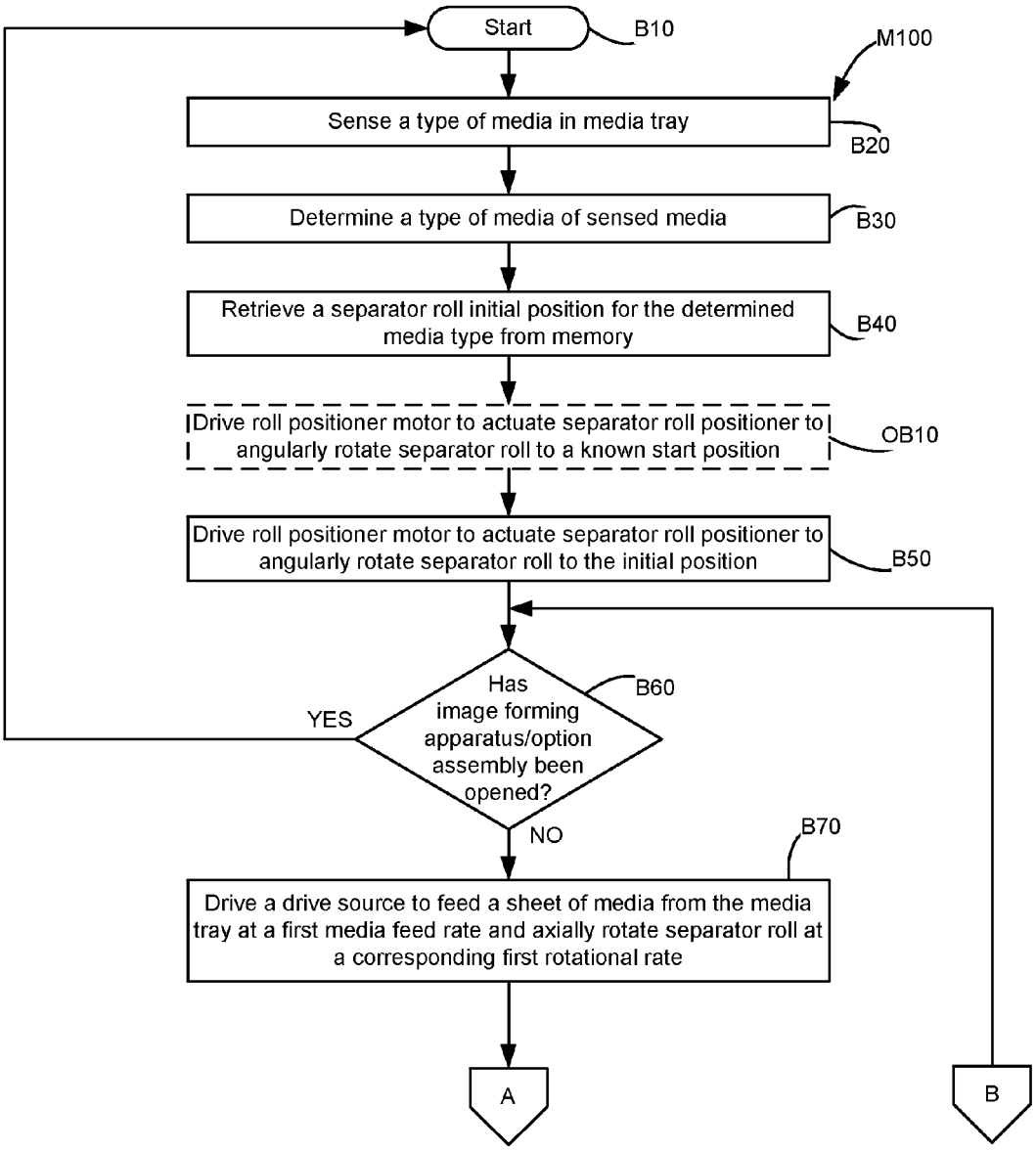
FIG. 20 is a flow diagram of a method of using the separator roll positioner for adjusting the separation force applied to a sheet of media being fed from a media tray.

A method M100 for varying the separation force applied by the separator rolls is illustrated in FIG. 20. At block B10, the method starts. At block B20, media type sensor 15 senses a type of media in the media storage of removable media tray 100 and provides a signal indicative of the type of media sensed to the controller 3. Thereafter at controller 3, method M10 at block B30 determines the type of media sensed. At block B40 based upon the determined type of media a predetermined initial position of the separator roll with respect to the media contact surface is retrieved from memory 8. Thereafter, at block B50, controller 3 drives the roll positioner motor 260 to actuate separator roll positioner to 550 to angularly rotate separator roll 504 to the initial position with respect to the media contact surface. At optional block OB10, prior to block B50, controller 3 may first drive roll positioner motor 260 to actuate separator roll positioner 550 to move separator roll 504 to a known starting location and then proceed to block B50. At Block B60, a determination is made to see if the image forming apparatus and/or the option assembly where the removable media tray that is being used has been opened. When a determination has been made that such image forming apparatus and/or option assembly has been opened, method M100 loops back to the start at block B10. When the device holding the media tray being used is opened, there is a possibility that a different media type may have been placed in the media tray. When a determination has been made that such image forming apparatus and/or option assembly has not been opened, method M100 proceeds to block B70. At block B70, controller 3 drives the drive motor 250 to actuate the media feed system 12 to feed a sheet of media from the media storage area 140 of removable media input tray 100 in the media process direction into media path P at a first media feed rate and to axially rotate the separator roll in a direction counter to the media process direction at a corresponding rotational speed. The rotation of the separator roll applies a separation force to a following sheet of media being feed at a first media feed rate. As is known, as the media feed rate increases there is a corresponding rotational speed for the separator roll increases.

Figure 21:
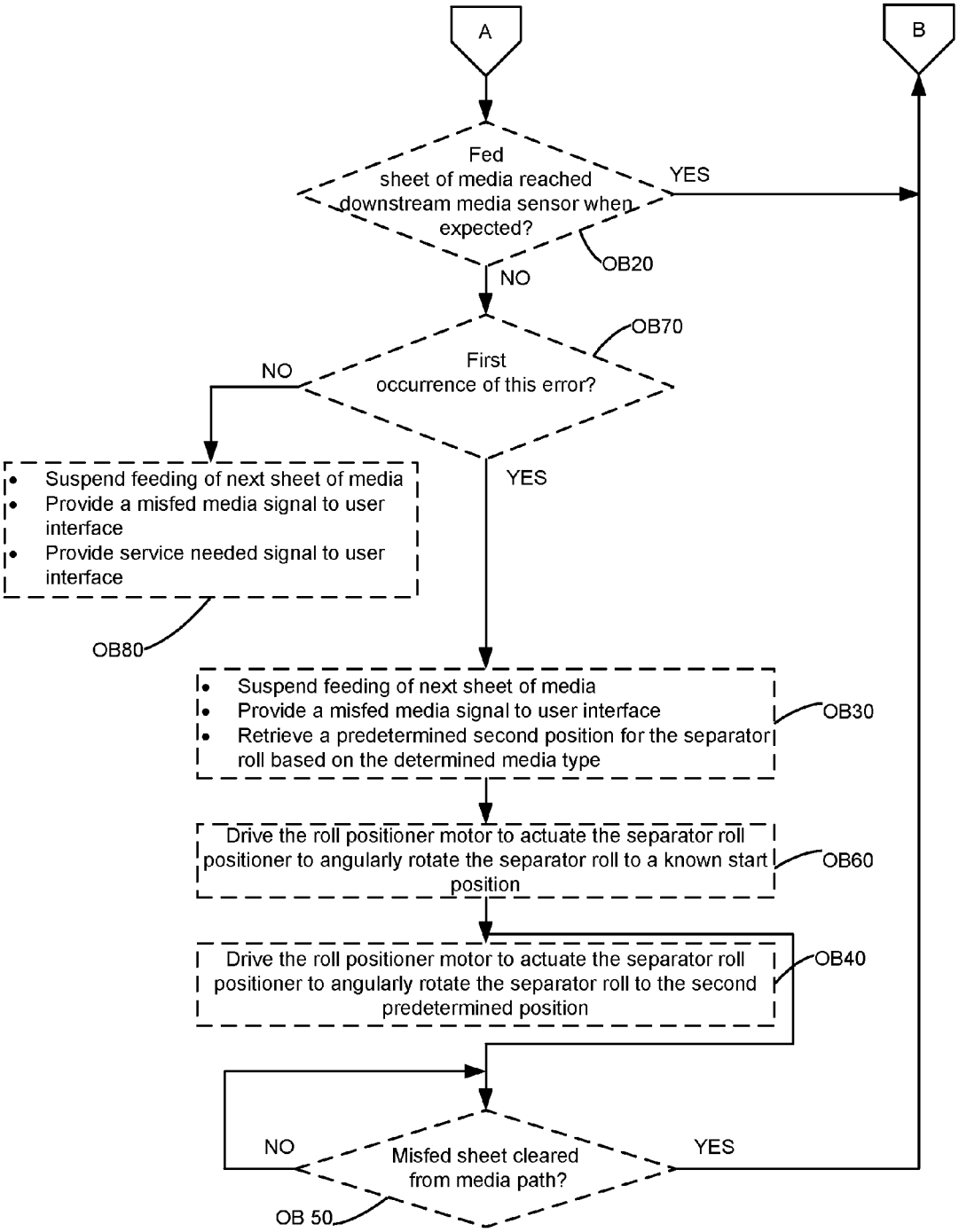
FIG. 21 is a modification of the method of FIG. 20 providing for readjustment of the separator roll with respect to the media contact surface of the media dam upon the occurrence of a misfeed.
Figure 22:
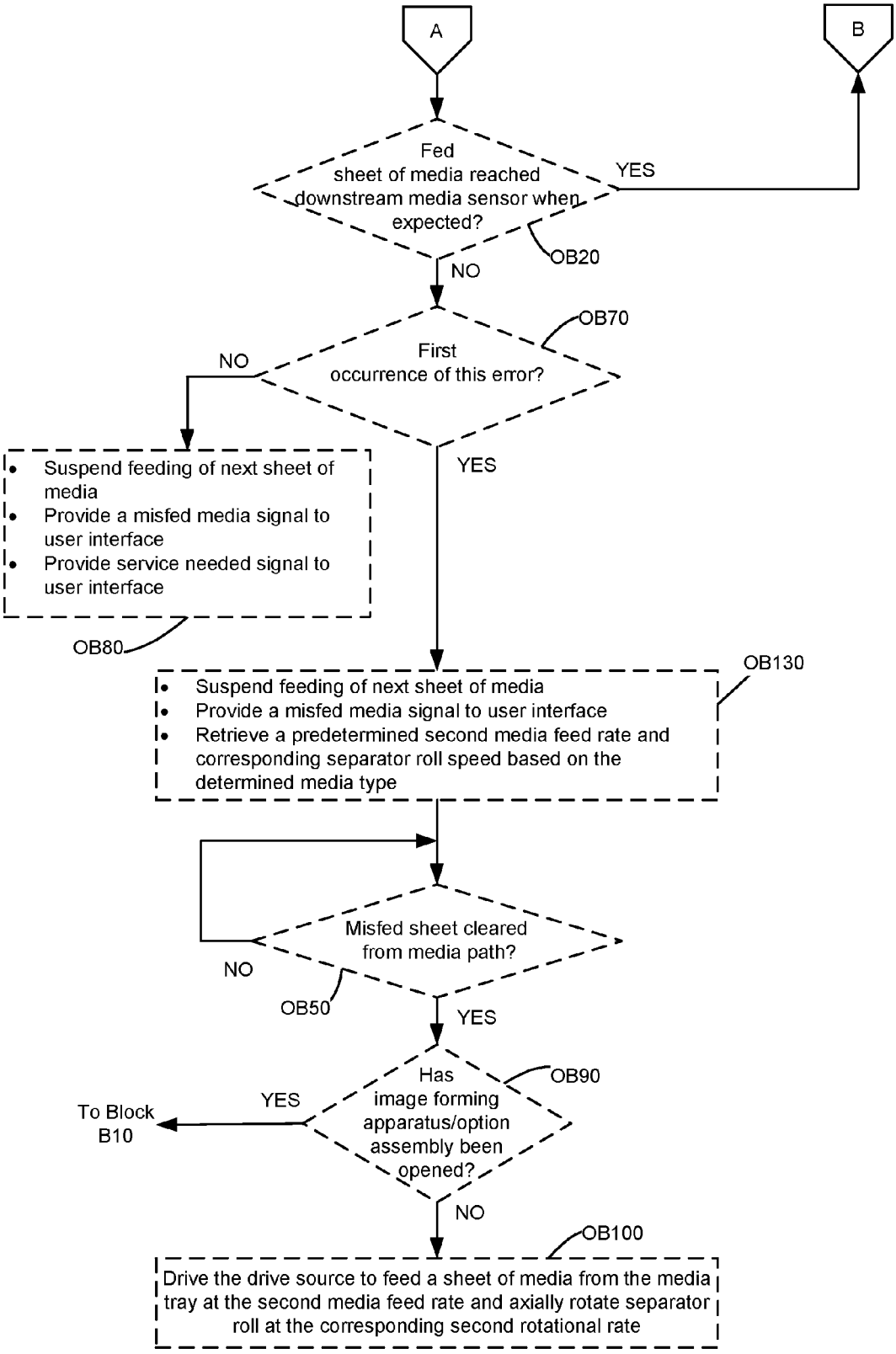
FIG. 22 is a further modification of the method of FIG. 20 providing for readjustment of the media feed rate and separator roll rotational speed upon the occurrence of a misfeed.
Figure 23:
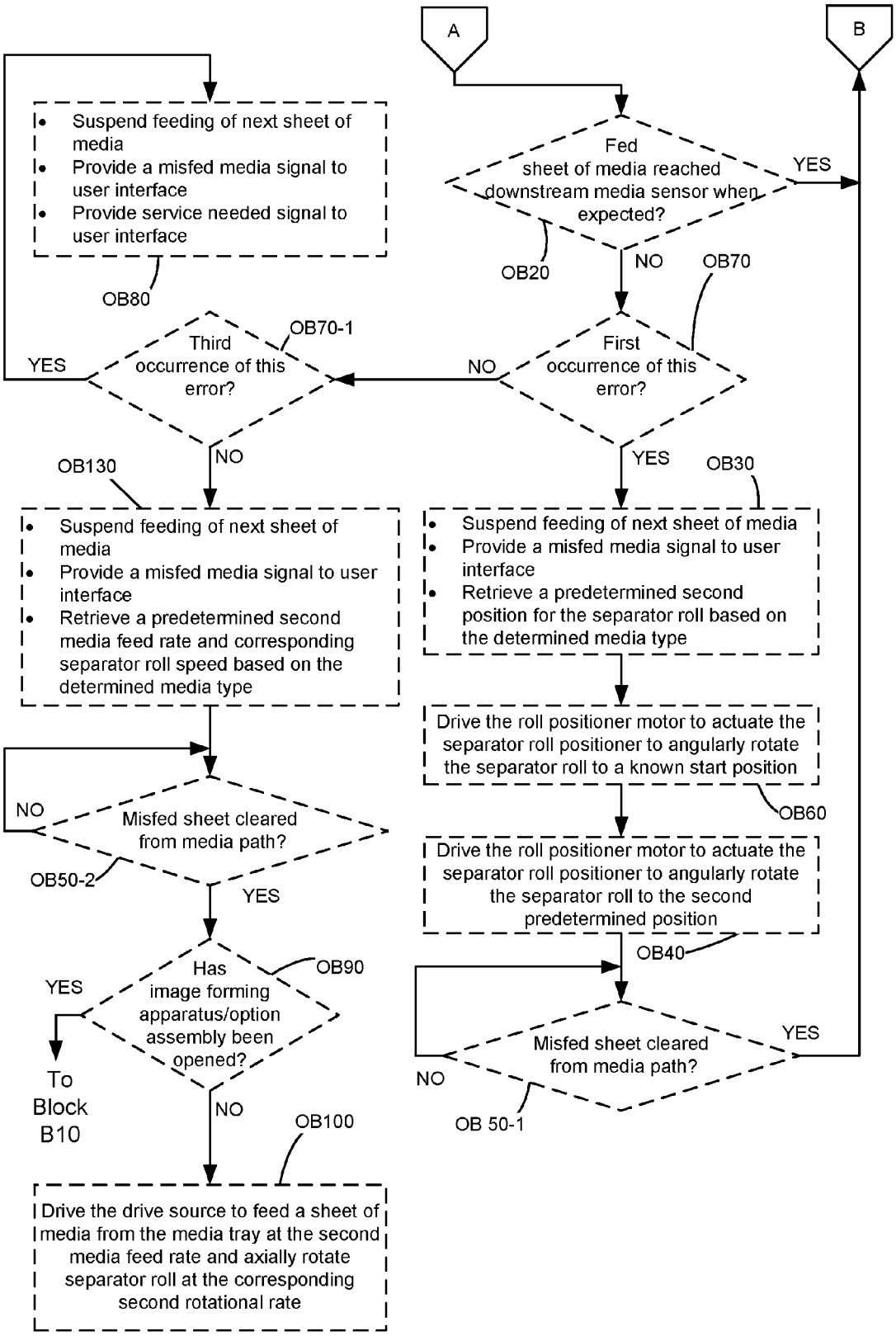
FIG. 23 is a still further modification of the method of FIG. 20 providing for readjustment of the separator roll with respect to the media contact surface of the media dam upon the occurrence of a misfed and providing for readjustment of the media feed rate and separator roll rotational speed upon the occurrence of a second misfeed.

With reference to FIGS. 21-23, method M100 may be further augmented using one or more of the downstream media sensors such as media sensors 19 or 240 in a superior unit to handle various media misfeed conditions, such as failure to feed and multiple feeds or shingling. FIGS. 21 and 22 illustrate alternate approaches to a general case of a media misfeed. In FIG. 21 method M100 proceeds from block B70 to optional block OB20 where a determination is made whether or not the fed sheet of media has reached the downstream media sensor when expected. When it is determined that the fed media sheet has not reached the downstream media sensor when expected then at optional block OB30, the feeding of the next sheet of media is suspended, a media misfeed signal is provided on user interface 7 and, based upon the determined type of media, a predetermined second position of the separator roll with respect to the media contact surface is retrieved from memory. Thereafter, at optional block OB40, controller 3 drives roll positioner motor 260 to actuate the separator roll positioner to angularly rotate the separator roll to the predetermined second position. Again prior to optional block OB40, at optional block OB60, controller 3 may first drive roll positioner motor 260 to actuate separator roll positioner 550 to move separator roll 504 to a known starting location and then proceed to optional block OB40. Thereafter, at optional block OB50, a determination is made to see whether or not the misfed media sheet has been cleared from the media path. When it is determined that the misfed media sheet has been cleared, method M100 proceeds back to block B60 to check if the imaging apparatus or option assembly has been opened before proceeding with the feeding of the next sheet of media. When it is determined that the misfed media sheet has not been cleared from the media path P, method M100 loops back to optional block OB50 to wait for the misfed media sheet to be cleared from the media path P. When it is determined, at optional block OB20, that the fed media sheet has reached the downstream media sensor when expected, then method M100 loops back to block B60 as previously described.

At optional block OB70 a further check may be made after optional block OB20 when it is determined that the sheet of media did not arrive when expected. There a check is made to determine if this is the first occurrence of this error. When it is determined that it is the first occurrence, method 100 proceeds to optional block OB30. When it is determined that it is not the first occurrence of the error, method 100 proceeds to optional block OB80 where the feeding of the next sheet of media is suspended, a media misfeed signal and service needed signal is provided on user interface and the method ends until the imaging apparatus is serviced. It will be realized that number of times that the error occurs before service is requested may be increased and calling for service on the second occurrence as illustrated is not a limitation of the method.

In FIG. 22, another modification of method M100 is shown. As shown there at optional block OB20, when it is determined that the fed media sheet has not reached the downstream media sensor when expected then, at optional block OB130, the feeding of the next sheet of media is suspended, a media misfeed signal is provided on user interface and a predetermined second media feed rate and corresponding second separator roll speed based on the determined media type is selected by controller 3. Method M100 then proceeds to optional block OB50 that has been previously described. When, at optional block OB50, a determination is made that the misfed sheet has been cleared from the media path, a determination is made at optional block OB90 to see if the image forming apparatus or option assembly has been opened. When it is determined that such opening has occurred, method M100 loops back to the start at block B10. When it is determined that such opening has not occurred then, at optional block OB100, the drive source, e.g., feed motor 250, is driven at a second media feed rate and separator rolls 504 are rotated at a corresponding second rotational rate. For example, should the reason that the fed media sheet did not reach the media sensor when expected be because there was a failure to feed, then the second media feed rate and the second corresponding separator roll rotational speed would be reduced. Conversely, if, should the reason that the fed media sheet did not reach the media sensor when expected be because there was a multiple feed or shingling, then the second media feed rate and the second corresponding separator roll rotational speed would be increased. Also, the opening check performed at optional block OB90 may be skipped.

Stored within memory 8, is a table of media types and corresponding initial media feed rates and corresponding separator roll rotational speeds. These are empirically determined. For media types that are already at the maximum media feed rate, it will be realized that should shingling or multiple feeds occur, the media feed rate and separator roll rotational speed will not be able to be increased. In such case, controller 3 would know not to do so at optional block OB100 Similarly, where the lowest media fed rate is being used, controller 3 would know that it could not reduce the media feed rate below the lowest media fed rate when there is a failure to feed error. Example media feed rates are 70 ppm (pages per minute), 63 ppm, 55 ppm, 50 ppm, 35 ppm, and 22 ppm. Corresponding rotational speeds for the separator roll would 95 rpm, 86 rpm, 75 rpm, 68 rpm 49 rpm and 30 rpm. Shown in Table 2 are initial media feed rates based on the determined type of media.

TABLE 2

| Media Type | Media Weight ($gm/m^{2)}$ | Initial Media Feed Rate (ppm) |
|---|---|---|
| Vinyl | >275 | 35 |
| Cardstock | 176-203 | 35 |
| Label | 160-180 | 35-55 |
| Polyester | 176-220 | 35 |
| Paper | 105-176 | 50-70 |
| Cardstock | 135-176 | 50-55 |
| Polyester | 176-220 | 35 |
| Paper, Cardstock, Paper Labels, Pharmacy Labels | 60-75 | 50-70 |
| Vinyl | 260-275 | 35 |
| Paper | <60 | 50-70 |
| Label | 60-130 | 50-55 |

Again optional blocks OB70 and OB80 as previously described may also be used with the modified method shown in FIG. 22.

A still further modification of method M100 is shown in FIG. 23. This modification, in general, is one where in the event of a misfeed the angular position of the separator roll is moved to a second position and should a subsequent misfeed occur then the media feed rate and the rotational speed of the separator roll is changed to a second predetermined media feed rate and corresponding second separator roll rotational speed. Blocks having the same or similar functions as blocks previously described will be referenced with the same or similar numbers.

In FIG. 23 at optional block OB20, a determination is made whether or not the fed sheet of media has reached the downstream media sensor when expected. When it is determined that the fed media sheet has not reached the downstream media sensor when expected then, at optional block OB70, a check is made to determine if this is the first occurrence of this error. When it is determined that it is the first occurrence, method 100 proceeds to optional block OB30. When it is determined that it is not the first occurrence, method 100 proceeds to optional block OB130.

At optional block OB30, the feeding of the next sheet of media is suspended, a media misfeed signal is provided on user interface 7 and, based upon the determined type of media, a predetermined second position of the separator rolls 504 with respect to the media contact surface is retrieved from memory. Thereafter, at optional block OB40, controller 3 drives roll positioner motor 260 to actuate the separator roll positioner to angularly rotate the separator rolls 504 to the predetermined second position. Prior to optional block OB40, at optional block OB60, controller 3 may first drive roll positioner motor 260 to actuate separator roll positioner 550 to move separator roll 504 to a known starting location and then proceed to optional block OB40. Thereafter, at optional block OB50-1, a determination is made to see whether or not the misfed media sheet has been cleared from the media path. When it is determined that the misfed media sheet has been cleared, method M100 proceeds back to block B60 to check if the imaging apparatus or option assembly has been opened before proceeding with the feeding of the next sheet of media. When it is determined that the misfed media sheet has not been cleared from the media path P, method M100 loops back to optional block OB50-1 to wait for the misfed media sheet to be cleared from the media path P. When it is determined, at optional block OB20, that the fed media sheet has reached the downstream media sensor when expected, then method M100 loops back to block B60 as previously described.

At optional block OB130, the feeding of the next sheet of media is suspended, a media misfeed signal is provided on user interface, a predetermined second media feed rate and a corresponding separator roll speed based on the determined media type is selected by controller 3. Method M100 then proceeds to optional block OB50-2. When, at optional block OB50-2, a determination that the misfed sheet has been cleared from the media path, a determination is made at optional block OB90 to see if the image forming apparatus or option assembly has been opened. When it is determined that such opening has occurred, method M100 loops back to the start at block B10. When it is determined that such opening has not occurred then, at optional block OB100, the drive source, e.g., feed motor 250, is driven at a second media feed rate and separator rolls 504 are rotated at a corresponding second rotational rate.

A further check may be made after optional block OB20 when it is determined that the sheet of media did not arrive when expected. There, at optional block OB70, a check is made to determine if this is the first occurrence of this error. When it is determined that it is the first occurrence, method M100 proceeds to optional block OB30. When it is determined that it is not the first occurrence of the error, method M100 proceeds to optional block OB80 where the feeding of the next sheet of media is suspended, a media misfeed signal and service needed signal is provided on user interface and the method ends until the imaging apparatus is serviced. It will be realized that the number of times that the error occurs before service is requested may be increased and calling for service on the second occurrence as illustrated is not a limitation of the method.

Again a modified form of optional block OB70, labeled optional block OB70-1 may also be used with the modified method shown in FIG. 23. Optional block OB70-1 is modified to determine whether or not it was the third occurrence of the error that the fed sheet of media did not arrive when expected. Optional block OB70-1 would be performed after it was determined that it was not the first occurrence of the error that the fed sheet of media did not arrive when expected. Again, at optional block OB70-1 when it is determined that it was not the third occurrence of the error, method M100 would proceed to optional block OB130, and, when it is determined that it is the third occurrence of the error, method M100 would proceed to optional block OB80 as previously described.

While the foregoing serial process of FIG. 23 changed the angular position of separator rolls 504 first then followed with a change to a second speed, the method may also be practiced so that the second speed is chosen first followed by a change of angular position of separator rolls 504.

With the foregoing methods, when the reason that the fed media does not reach the media sensor when expected is due to a failure to feed error, i.e., the leading edge of the fed media sheet is not detected within an expected time period at the media sensor downstream of the media tray being used, then one of the following actions would occur: the angular position or extension of separator rolls 504 with respect to the media dam surface 502 would be decreased; the rotational speed of separator rolls 504 would be decreased; and, both the angular position and rotational speed of separator rolls 504 would be decreased. When the reason that the fed media does not reach the media sensor when expected is due to a shingling or a multiple feed error, i.e., the trailing edge of the fed media sheet is not detected within an expected time period at the media sensor downstream of the media tray being used, then one of the following actions would occur: the angular position or extension of separator rolls 504 with respect to the media dam surface 502 would be increased; the rotational speed of separator rolls 504 would be increased; and, both the angular position and rotational speed of separator rolls 504 would be increased.

The foregoing description of method M100 is not intended to described all of the steps down in feeding media from the removable media tray through to the exit of the image forming apparatus but is intended to describe various approaches in which the position or rotational speed of the separator roll may be changed to provide a different magnitude of separation force in the event of a shingling error or a failure to feed error for a given type of media. The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A removable media input tray for a media feed device, comprising:

a bottom, a front wall, a rear wall and two side walls extending between the front and rear walls, the walls extending upwardly from the bottom, the walls and bottom defining a media storage location for holding media to be fed by the media feed device;

the front wall having a front portion having a first height, a rearwardly extending top portion, two side portions extending rearward from the front portion and downward from the top portion and a rear portion, the rear portion extending vertically from the bottom to a second height that is less than the first height, the front portion, the top portion, the two side portions and the rear portion defining a cavity in the front wall;

a mount disposed on one of the side portions of the front wall; and a removable media dam structure removably mountable within the cavity in the front wall, the removable media dam comprising:

a top panel;

a rear panel;

a media contact surface having a top edge and a bottom edge and having an opening therethrough;

a pair of opposed side panels depending from the media contact surface, the top panel and the rear panel with the media contact surface extending between the side portions of the front wall with the top edge proximate the top panel and the bottom edge proximate the top of the back portion of the front wall wherein the pair of opposed side panels, the top panel, the rear panel and the media contact surface define a cavity in the removable media dam structure;

a mount on one of the opposed side panels for removable engagement with the mount on one of the side portions of the front wall so that the media contact surface forms an obtuse angle with respect to the bottom of the tray when the removable media dam structure is mounted in the cavity in the front wall;

a support positioned within the cavity in the removable media dam structure with the opening through the media contact surface positioned between the support and one side panel of the pair of opposed side panels; and a separator roll positioner pivotally mounted between the support and the one side panel, the separator roll positioner including a wheelset rotatably mounted therein and having an axis of rotation that is transverse to the two side walls of the media tray, the wheelset having an axle with a separator roll mounted thereon with an end of the axle being engageable with a drive source in the media feed device for axially rotating the wheel set and the separator roll being aligned with and moveable through the opening in the media contact surface;

wherein pivoting the separator roll positioner angularly rotates the separator roll to and maintains the separator roll at one of a retracted position, one or more intermediate positions and an extended position with respect to the media contact surface where, when in the retracted position, a radial surface of the separator roll is at a first height with respect to the media contact surface, where, when in the extended position, the radial surface of the separator roll is at a second height with respect to the surface of the media contact surface that is greater than the first height and where, when in the one or more intermediate positions, the radial surface of the separator roll has respective heights that are greater than the first height and less than the second height.

2. The removable media input tray of claim 1, wherein, when the separator roll is in the retracted position, the radial surface of the separator roll is one of at and below the surface of the media contact surface.

3. The removable media input tray of claim 1, wherein, when the separator roll is in extended position, the radial surface of the separator roll is at a second height of approximately 3.18 mm above the surface of the media contact surface.

4. The removable media input tray of claim 1, wherein, when the separator roll is being adjusted between the retracted position and the extended position, the wheel set angularly rotates through a travel arc of approximately twenty-four degrees.

5. The removable media input tray of claim 4, wherein, when the separator roll is being adjusted from one of the plurality of intermediate positions to one of the retracted and extended positions, the wheel set angularly rotates through a travel arc of approximately twelve degrees.

6. The removable media input tray of claim 1, wherein the mount on the front wall and the mount on the removable media dam structure form a snap-fit when the media dam is removably mounted in the cavity in the front wall.

7. The removable media input tray of claim 1, wherein the removable media dam structure is a tool-free removable media dam structure.

8. The removable media input tray of claim 1, wherein the mount on the removable media dam structure comprises a pair of posts extending outwardly from one of the opposed side panels that are received into corresponding openings in one of the side portions of the front wall and a latch catch on the other of the opposed side panels that engages a latch on the other of the side portions of the front wall.

9. The removable media input tray of claim 1, further comprising a drive mechanism mounted to the top panel and operably coupled to the separator roll positioner wherein rotation of the drive mechanism in one direction effects angular rotation of the wheel set toward the extended position and rotation of the drive mechanism in a second direction opposite the first direction effects angular rotation of the wheel set toward the retracted position.

10. The removable media input tray of claim 9, wherein the drive mechanism comprises a worm gear rotatably mounted to the top panel and is operably coupled to the separator roll positioner wherein rotation of the worm gear in one direction effects angular rotation of the wheel set toward the extended position and rotation of the worm gear in a second direction opposite the first direction effects angular rotation of the wheel set toward the retracted position.

11. The removable media input tray of claim 10 further comprising a positioner motor operably coupled to the worm gear to rotate the worm gear.

12. The removable media input tray of claim 1, further comprising an axle gear mounted outboard of the one side panel on the end of the axle that is engageable with the drive source and a pivot gear rotatably mounted on one of the side walls adjacent the one side panel wherein, when the removable media dam is mounted in the cavity in the front wall, the axle gear is operably coupled to the pivot gear and the drive source and upon subsequent actuation of the separator roll positioner to angularly rotate the wheel set, the axle gear rotates about a portion of the circumference of the pivot gear.

13. The removable media input tray of claim 12 further comprising a clutch operably coupled between the axle gear and the axle.

14. The removable media input tray of claim 12 further comprising a flexible coupling operably coupled between the axle gear and the axle.

15. The removable media input tray of claim 1 further comprising:

a second support positioned in the cavity in the removable media dam structure inboard of the support;

the media contact surface having a second opening therethrough positioned between the support and the second support;

a second separator roll positioner pivotally mounted between the support and the second support, the separator roll positioner including a second wheelset rotatably mounted therein and having an axis of rotation that is transverse to the two side walls of the media tray, the second wheelset having an axle with a separator roll mounted thereon with an end of the axle adjacent to the first separator roll positioner being coupleable with the other end of the axle of the first separator roll positioner and the separator roll of the second separator roll positioner being aligned with and moveable through the second opening in the media contact surface;

wherein pivoting the second separator roll positioner angularly rotates the separator roll of the second wheelset to and maintains the separator roll of the second wheelset at one of a retracted position, one or more intermediate positions and an extended position with respect to the media contact surface where, when in the second retracted position, a radial surface of the separator roll of the second wheelset is at a first height with respect to the media contact surface, where, when in the extended position, the radial surface of the separator roll of the second wheelset is at a second height with respect to the surface of the media contact surface that is greater than the first height and where, when in the one or more intermediate positions, the radial surface of the separator roll of the second wheelset has respective heights that are greater than the first height and less than the second height and further wherein the respective positions of the separator roll in the separator roll positioner and the separator roll in the second separator roll positioner are one of the same position with respect to the media contact surface and different positions with respect to the media contact surface.

16. The removable media tray of claim 15 wherein the position of the separator roll in the separator roll positioner with respect to the media contact surface is the same as the position of the separator roll in the second separator roll positioner with respect to the media contact surface.

17. The removable media tray of claim 15 wherein the position of the separator roll in the separator roll positioner with respect to the media contact surface is different from the position of the separator roll in the second separator roll positioner with respect to the media contact surface.

18. A removable media input tray for a media feed device, comprising:

a bottom, a front wall, a rear wall and two side walls extending between the front and rear walls, the walls extending upwardly from the bottom, the walls and bottom defining a media storage location for holding media to be fed by the media feed device;

the front wall having a front portion having a first height, a rearwardly extending top portion, two side portions extending rearward from the front portion and downward from the top portion and a rear portion, the rear portion extending vertically from the bottom to a second height that is less than the first height, the front portion, the top portion, the two side portions and the rear portion defining a cavity in the front wall;

a mount disposed on one of the side portions of the front wall; and a removable media dam structure removably mountable within the cavity in the front wall, the removable media dam structure comprising:

a top panel having a slot with an undersurface of the top panel having a plurality of spaced detents aligned along a length of the slot;

a rear panel;

a media contact surface having a top edge and a bottom edge and having an opening therethrough;

a pair of opposed side panels depending from the media contact surface, the top panel and the rear panel, the media contact surface extending between the side portions of the front wall with the top edge proximate the top panel and the bottom edge proximate the top of the back portion of the front wall;

the pair of opposed side panels, the top panel, the rear panel and the media contact surface defining a cavity in the removable media dam structure;

a mount on one of the opposed side panels for removable engagement with the mount on one of the side portions of the front wall so that the media contact surface forms an obtuse angle with respect to the bottom of the tray when the removable media dam structure is mounted in the cavity in the front wall;

a support positioned within the cavity in the removable media dam structure with the opening through the media contact surface positioned between the support and one side panel of the pair of opposed side panels; and a separator roll positioner pivotally mounted between the support and the one side panel, the separator roll positioner comprising:

a bracket having a lever and a pair of arms depending from a support member, the pair of arms pivotally mounted to the support and the one side panel, and the lever having a catch thereon sized to be received in one of the plurality of detents and a tab on a distal end of the lever, the tab extending through the slot; and a wheel set including a separator roll mounted on an axle, the wheel set being rotatably mounted within the bracket between the pair of arms and having an axis of rotation that is transverse to the two side walls of the media tray with one end of the axle extending through one arm of the pair of arms that is adjacent to the one side panel and through an opening in the one side panel, the one end of the axle being engageable with a drive source in the media feed device for axially rotating the wheel set;

wherein movement of the tab of the lever along the slot pivots the bracket angularly rotating the separator roll of the wheel set to between a retracted position, one or more intermediate positions and an extended position where, when in the retracted position, the radial surface of the separator roll is at a first height with respect to the media contact surface, where, when in the extended position, the radial surface of the separator roll is at a second height with respect to the surface of the media contact surface that is greater than the first height and where, when in the one or more intermediate positions, the radial surface of the separator roll has respective heights that are greater than the first height and less than the second height with one detent of the plurality of detents being positioned at each of the retracted, extended and one or more intermediate positions for engaging the catch to maintain the separator roll at a selected one of the retracted, extended and one or more intermediate positions.

19. The removable media input tray of claim 18, wherein, when the separator roll is in the retracted position, the radial surface of the separator roll is one of at and below the surface of the media contact surface.

20. The removable media input tray of claim 18, wherein, when the separator roll is in extended position, the radial surface of the separator roll is at a second height of approximately 3.18 mm above the surface of the media contact surface.

21. The removable media input tray of claim 18, wherein, when the separator roll is being adjusted between the retracted position and the extended position, the wheel set angularly rotates through a travel arc of approximately twenty-four degrees.

22. The removable media input tray of claim 21, wherein, when the separator roll is being adjusted from one of the plurality of intermediate positions to one of the retracted and extended positions, the wheel set angularly rotates through a travel arc of approximately twelve degrees.

23. The removable media input tray of claim 18, further comprising a drive mechanism mounted to the top panel and operably coupled to the tab of the lever wherein rotation of the drive mechanism in one direction effects angular rotation of the wheel set toward the extended position and rotation of the drive mechanism in a second direction opposite the first direction effects angular rotation of the wheel set toward the retracted position.

24. The removable media input tray of claim 23, wherein the drive mechanism comprises a dial rotatably mounted to the top panel and having a slot therein operably coupled to the tab of the lever wherein rotation of the dial in one direction effects angular rotation of the wheel set toward the extended position and rotation of the dial in a second direction opposite the first direction effects angular rotation of the wheel set toward the retracted position.

25. The removable media input tray of claim 23, wherein the drive mechanism comprises a worm gear rotatably mounted to the top panel and aligned with the length of the slot and is operably coupled to the tab of the lever wherein rotation of the worm gear in one direction effects angular rotation of the wheel set toward the extended position and rotation of the worm gear in a second direction opposite the first direction effects angular rotation of the wheel set toward the retracted position.

26. The removable media input tray of claim 25 further comprising a positioner motor operably coupled to the worm gear to rotate the worm gear.

27. The removable media input tray of claim 18, further comprising an axle gear mounted outboard of the one side panel on the end of the axle extending therethrough and a pivot gear rotatably mounted on one of the side walls adjacent the one side panel wherein, when the removable media dam is mounted in the cavity in the front wall, the axle gear is operably coupled to the pivot gear and, upon subsequent actuation of the separator roll positioner to angularly rotate the wheel set, the axle gear rotates about a portion of the circumference of the pivot gear.

28. The removable media input tray of claim 27 further comprising a clutch operably mounted between the axle gear and the axle.

29. The removable media input tray of claim 27 further comprising a flexible coupling operably mounted between the axle gear and the axle.

30. The removable media input tray of claim 18 further comprising:

a second support positioned in the cavity in the removable media dam structure inboard of the support;

the media contact surface having a second opening positioned between the support and the second support;

the top panel having a second slot therethrough positioned between the support and the second support and a second plurality of detents on the undersurface of the top panel and aligned with a length of the second slot;

a second separator roll positioner being rotatably mounted between the one side panel and the second support, the second separator roll positioner comprising:

a second bracket having a second lever and a pair of arms depending from a support member, the pair of arms pivotally mounted to the support and the second support, and the second lever having a catch thereon sized to be received in one of the second plurality of detents and a tab on a distal end of the lever, the tab extending through the second slot; and a second wheel set including a second separator roll mounted on a second axle, the second wheel set being rotatably mounted between the pair of arms of the second bracket and having an axis of rotation that is transverse to the two side walls of the media tray with one end of the second axle extending through one arm of the pair of arms that is adjacent to the support, the one end of the second axle being coupleable the other end of the axle of the separator roll positioner rotating the wheel set;

a flexible coupler operably mounted to the coupleable end of the second axle and to the other end of the axle of the separator roll positioner;

wherein movement of the tab of the second lever along the second slot pivots the second bracket angularly rotating the second wheel set between a retracted position, one or more intermediate positions and an extended position where, when in the retracted position, the radial surface of the separator roll of the second wheel set is at a first height with respect to the media contact surface, where, when in the extended position, the radial surface of the separator roll of the second wheelset is at a second height with respect to the surface of the media contact surface that is greater than the first height, and where, when in the one or more intermediate positions, the radial surface of the separator roll of the second wheelset has respective heights that are greater than the first height and less than the second height with one detent of the second plurality of detents being positioned at each of the retracted, extended and one or more intermediate positions for engaging the catch of the second lever to maintain the separator roll of the second wheelset at a selected one of the retracted, extended and one or more intermediate positions.

31. A removable media dam structure for removable mounting in a cavity in a front wall of a media input tray for a media feed device, the front wall having a front portion having a height H1, a rearwardly extending top portion, two side portions extending rearward from the front portion and downward from the top portion and a back portion, the back portion extending vertically from the bottom to a height H2 that is less than the height H1 and a pair of opposed mounts on the side portions of the front wall, the removable media dam structure comprising:

a top panel;

a rear panel;

a media contact surface having a top edge, a bottom edge, and opposed first and second side panels depending from the media contact surface, the media contact surface extending between the side portions of the front wall with the top edge proximate the top of the front portion of the front wall and the bottom edge proximate the top of the back portion wherein the opposed first and second side panels, the top panel, the rear panel and the media contact surface define a cavity in the removable media dam structure;

a pair of mounts respectively mounted on the opposed first and second side panels for removable engagement with respective ones of the pair of opposed mounts on the side portions of the front wall so that the media contact surface forms an obtuse angle with respect to the bottom of the media input tray when the media dam structure is mounted in the cavity in the front wall;

a support positioned within the cavity in the removable media dam structure with the opening through the media contact surface positioned between the support and one side panel of the pair of opposed side panels; and a separator roll positioner pivotally mounted between the support and the one side panel, the separator roll positioner including a wheelset rotatably mounted therein and having an axis of rotation that is transverse to the two side portions of the media tray, the wheelset having an axle with a separator roll mounted thereon with an end of the axle being engageable with a drive source in the media feed device for axially rotating the wheel set and the separator roll aligned with and moveable through the opening in the media contact surface;

wherein pivoting the separator roll positioner angularly rotates the separator roll to and maintains the separator roll at one of a retracted position, one or more intermediate positions and an extended position with respect to the media contact surface where, when in the retracted position, a radial surface of the separator roll is at a first height with respect to the media contact surface, where, when in the extended position, the radial surface of the separator roll is at a second height with respect to the surface of the media contact surface that is greater than the first height and where, when in the one or more intermediate positions, the radial surface of the separator roll has respective heights that are greater than the first height and less than the second height.

32. The removable media dam structure of claim 31, wherein one of the pair of mounts on the removable media dam structure comprises a pair of posts extending outwardly from the first side panel and the other one of the pair of mounts comprises a latch catch on the second side panel.

* * * * *